US008801517B2

(12) United States Patent
Walker et al.

(10) Patent No.: US 8,801,517 B2
(45) Date of Patent: Aug. 12, 2014

(54) METHOD AND APPARATUS FOR OPTIMIZING THE RATE OF PLAY OF A GAMING DEVICE

(75) Inventors: Jay S. Walker, Ridgefield, CT (US); James A. Jorasch, Stamford, CT (US); David F. Zucker, Winnetka, IL (US); Jose A. Suarez, Fairfield, CT (US); Stephen C. Tulley, Fairfield, CT (US); Geoffrey M. Gelman, Stamford, CT (US); Steven M. Santisi, Ridgefield, CT (US)

(73) Assignee: IGT, Las Vegas, NV (US)

( * ) Notice: Subject to any disclaimer, the term of this patent is extended or adjusted under 35 U.S.C. 154(b) by 3845 days.

(21) Appl. No.: 10/417,436

(22) Filed: Apr. 16, 2003

(65) Prior Publication Data

US 2003/0232640 A1 Dec. 18, 2003

Related U.S. Application Data

(60) Provisional application No. 60/373,110, filed on Apr. 16, 2002.

(51) Int. Cl.
*G07F 17/32* (2006.01)

(52) U.S. Cl.
USPC ..... 463/16; 463/20; 463/23

(58) Field of Classification Search
USPC ..... 463/23, 16, 20
See application file for complete search history.

(56) References Cited

U.S. PATENT DOCUMENTS

| | | | | | |
|---|---|---|---|---|---|
| 4,366,960 | A | | 1/1983 | Bromley et al. | 273/85 G |
| 4,373,727 | A | * | 2/1983 | Hooker et al. | 273/143 R |
| 4,773,647 | A | | 9/1988 | Okada et al. | 273/143 R |
| 5,123,649 | A | | 6/1992 | Tiberio | 273/143 R |
| 5,370,399 | A | * | 12/1994 | Liverance | 463/23 |
| 5,472,197 | A | * | 12/1995 | Gwiasda et al. | 273/143 R |
| 5,758,875 | A | * | 6/1998 | Giacalone, Jr. | 273/143 R |
| 5,772,509 | A | | 6/1998 | Weiss | 463/16 |
| 5,971,850 | A | * | 10/1999 | Liverance | 463/23 |
| 6,352,516 | B1 | | 3/2002 | Pozos et al. | |
| 6,695,699 | B2 | * | 2/2004 | Beaulieu | 463/25 |
| 6,739,973 | B1 | * | 5/2004 | Lucchesi et al. | 463/35 |
| 6,764,397 | B1 | * | 7/2004 | Robb | 463/23 |
| 7,918,738 | B2 | * | 4/2011 | Paulsen | 463/43 |
| 2002/0006823 | A1 | | 1/2002 | Horio | |

* cited by examiner

*Primary Examiner* — Jay Trent Liddle
(74) *Attorney, Agent, or Firm* — Neal, Gerber & Eisenberg LLP

(57) ABSTRACT

The invention includes a system and method for determining and achieving an optimized rate of play of a gaming device for a given player. The system monitors play at a gaming device, determines whether adjustments to parameters that effect the potential maximum rate of play should be made, and makes the appropriate adjustments. Monitoring play includes measuring such things as force applied to input buttons and tracking unnecessary button presses at inappropriate times (i.e., while the reels are still spinning). Parameters that effect the potential maximum rate of play include reel resolution time, length of bonus displays, payout rate, and the like.

9 Claims, 9 Drawing Sheets

308

PLAYER IDENTIFIER: AP1111-23 500

PLAYER NAME: SAM BROWN 502

| | TIME 504 | EVENT 506 | DETAILS 508 |
|---|---|---|---|
| 510 | 1:26:02.83AM | 1 COIN INSERTED | |
| 512 | 1:26:03.60AM | "PLAY 3 LINES" BUTTON DEPRESSED | MAX FORCE: 2 NEWTONS |
| 514 | 1:26:03.91AM | "PLAY 3 LINES" BUTTON RELEASED | |
| 516 | 1:26:04.54AM | "BET 1 PER LINE" BUTTON DEPRESSED | MAX FORCE: 8 NEWTONS |
| 518 | 1:26:05.01AM | "BET 1 PER LINE" BUTTON RELEASED | |
| 520 | 1:26:05.20AM | REELS BEGIN SPINNING | |
| 522 | 1:26:06.77AM | "BET 1 PER LINE" BUTTON DEPRESSED | MAX FORCE: 1 NEWTON |
| 524 | 1:26:07.10AM | "BET 1 PER LINE" BUTTON RELEASED | |
| 526 | 1:26:08.04AM | REELS STOP SPINNING: CHERRY-BAR-BELL | |
| 528 | 1:26:08.50AM | 2 COIN PAYMENT BEGUN | |
| 530 | 1:26:08.95AM | 2 COIN PAYMENT COMPLETE | |
| 532 | 1:26:09.45AM | NEW INPUTS ALLOWED | |

FIG. 5

PLAYER TRACKING CARD NUMBER: P111123 600

PLAYER NAME: SAM BROWN 602

| TIME PERIOD 604 | NUMBER OF HANDLE PULLS COMPLETE 606 | NUMBER OF EXTRA TIMES "BET 1 PER LINE" PRESSED BEFORE REELS SPUN 608 | NUMBER OF EXTRA TIMES "BET 1 PER LINE" PRESSED WHILE REELS SPUN 610 | NUMBER OF TIMES ANY BUTTON HELD FOR MORE THAN 1 SECOND 612 | NUMBER OF TIMES COINS WERE ATTEMPTED TO BE INSERTED WHILE REELS SPUN 614 |
|---|---|---|---|---|---|
| 1:14:03 AM - 1:24:02 AM 616 | 100 | 70 | 84 | 20 | 15 |
| 1:24:03 AM - 1:34:02 AM 618 | 105 | 62 | 78 | 15 | 12 |
| 1:34:03 AM - 1:44:02 AM 620 | 109 | 55 | 64 | 12 | 8 |
| 1:44:03 AM - 1:54:02 AM 622 | 120 | 35 | 42 | 5 | 5 |

312

| | NUMBER OF EXCESS TIMES "SPIN" PRESSED 700 | NUMBER OF TIMES "STOP" PRESSED WHILE REELS STILL SPINNING 702 | AVERAGE LENGTH OF TIME BETWEEN WHEN "SPIN" AND "STOP" PRESSED 704 | NUMBER OF TIMES ANY BUTTON HELD FOR MORE THAN 1 SECOND 706 | CURRENT TIME OF REEL RESOLUTION 708 | ACTION 710 |
|---|---|---|---|---|---|---|
| 712 | -- | -- | -- | 10 OR MORE | -- | INCREASE ALL BUTTON SENSITIVITY BY 5% |
| 714 | 10 OR MORE | -- | -- | -- | -- | INCREASE "SPIN" BUTTON SENSITIVITY BY 5% |
| 716 | 10 OR MORE | 10 OR MORE | -- | -- | 1 SECOND OR LONGER | DECREASE SPIN TIME BY 0.1 SECONDS |
| 718 | 10 OR MORE | 10 OR MORE | 0.7 SECONDS OR LESS | -- | 1 SECOND OR LONGER | DECREASE SPIN TIME BY 0.2 SECONDS |
| 720 | 2 OR LESS | 2 OR LESS | -- | -- | 2 SECONDS OR LESS | INCREASE SPIN TIME BY 0.1 SECONDS |

FIG. 7

METHOD AND APPARATUS FOR OPTIMIZING THE RATE OF PLAY OF A GAMING DEVICE

RELATED APPLICATIONS

This application claims priority to commonly-owned, U.S. Provisional Patent Application Ser. No. 60/373,110, filed Apr. 16, 2002, entitled "SLOT MACHINE SPEED OPTIMIZATION" which is incorporated herein by reference in its entirety for all purposes.

FIELD OF THE INVENTION

The present invention relates to gaming devices. More specifically, the present invention relates to methods and apparatus for adjusting play parameters, such as rate of play, of gaming devices.

BACKGROUND OF THE INVENTION

There are currently over 500,000 slot machines in operation that together generate more than $15 billion in annual revenue for United States casinos. Most casinos generate more than half of their gaming revenues from slot machines and some individual casinos offer three or four thousand slot machines at a single location. In fact, two different casinos in Connecticut each provide over six thousand gaming devices for players.

Many players grow impatient and frustrated waiting for a slot machine outcome to resolve once they have pressed the "spin" button or made a handle pull. Further, casinos typically expect to earn an average amount of money, called the gaming device's "hold," on a given number of spins. Therefore, the higher the rate at which spins are made, the more money a casino earns.

BRIEF DESCRIPTION OF THE DRAWINGS

FIG. 5 is a table illustrating an example data structure of an example player session database 308 as depicted in FIG. 3 for use in some embodiments of the present invention.

FIG. 7 is a table illustrating an example data structure of an example rules database 312 as depicted in FIG. 3 for use in some embodiments of the present invention.

DETAILED DESCRIPTION OF SOME EMBODIMENTS OF THE INVENTION

Figure 1:
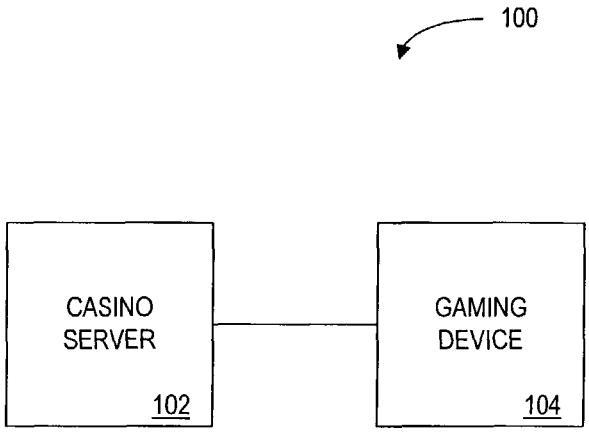
FIG. 1 is a block diagram illustrating an example system 100 according to some embodiments of the present invention.

The disclosed invention overcomes the above and other drawbacks of the prior art by allowing a gaming device, under certain conditions, to increase or decrease the rate at which reels resolve to an outcome. When reels resolve more quickly, a player has the opportunity to make a larger number of handle pulls in a given period of time, thereby increasing the maximum rate at which the gaming device can make profits. Players may enjoy a rate of play that is more suited to their preferences. Players also benefit from the opportunity to increase the number of outcomes viewed, and thereby to increase their entertainment within a given period of time.

In some embodiments, a gaming device monitors player actions during play. If the player performs actions or exhibits behaviors that indicate a desire to play faster, then the gaming device may increase the speed at which reels resolve. Such actions may include excess pressing of a "Spin" button, excess force applied to the spin button, patterns of increasing bet sizes, and so on. In some embodiments, the gaming device simply increases the speed at which reels resolve over the course of a playing session. The gaming device may stop increasing the rate at which reels resolve when player actions indicate that reels are resolving too fast, or when a certain minimum resolution time has been met.

With these and other advantages and features of the invention that will become hereinafter apparent, the nature of the invention may be more clearly understood by reference to the following detailed description of the invention, the appended claims and to the several drawings included herein.

In the following description, reference is made to the accompanying drawings that form a part hereof, and in which are shown, by way of illustration, specific embodiments in which the invention may be practiced. These embodiments are described in sufficient detail to enable those skilled in the art to practice the invention, and it is to be understood that other embodiments may be utilized and that structural, logical, software, and electrical changes may be made without departing from the scope of the present invention. The following description is, therefore, not to be taken in a limited sense, and the scope of the present invention is defined by the appended claims.

A. Terms

Throughout the description that follows and unless otherwise specified, the following terms may include and/or encompass the example meanings provided in this section. These terms and illustrative example meanings are provided to clarify the language selected to describe embodiments of the invention both in the specification and in the appended claims.

The terms "player" and "user" shall be synonymous and may refer to any person or entity that operates a user device, a gaming device, a player device, and/or a user terminal.

The terms "gaming device" and "gaming machine" shall be synonymous and may refer to any electrical, mechanical, electro-mechanical, software, combination thereof, and/or other device that may accept a wager, may follow a process to generate an outcome, and may pay winnings based on the outcome. The outcome may be randomly generated, as with a slot machine; may be generated through a combination of randomness and user skill, as with video poker; or may be generated entirely through user skill. A gaming device may include any gaming machine and/or system, including slot machines, video poker machines, video bingo machines, video roulette machines, video keno machines, video blackjack machines, arcade games, video games, pinball machines, skill crane machines, video lottery terminals, online gaming systems, game consoles, personal computers logged into online gaming sites, gaming device simulations, sports or race betting machine, etc. Gaming devices may or may not be owned and/or maintained by a casino and/or may or may not exist within a casino location. Gaming devices may be activated by a player pressing a spin button (including buttons labeled "bet", "wager", "deal", "start", "go", "hit", and/or the like), pulling a handle, and/or any other method to initiate the generation of an outcome.

The term "casino" may refer to the owner of gaming devices, owners' agents, and/or any entity who may profit from players' use of the gaming devices.

The term "casino location" may refer to the physical geographic site, complex, or building where gaming devices owned and/or operated by a casino are located. In the case of an online casino, casino location may refer to the address (e.g., the uniform resource locator (URL)) of the online casino's Web site or facility.

The terms "handle pull" and "spin" shall be synonymous and may refer to an action that initiates a single play at a gaming device. In some embodiments, a handle pull may refer to a single complete game (or hand) or in other embodiments, the term may refer to a play related to a single wager. For example, in video blackjack, a user might play a single game in which he splits a pair of sevens, requiring an additional wager. This single game may be considered to include one or multiple handle pulls in different embodiments.

The terms "server" and "casino server" shall be synonymous and may refer to any device that may communicate with one or more one or more gaming devices, one or more third-party servers, one or more remote controllers, one or more player devices, and/or other network nodes, and may be capable of relaying communications to and from each.

The term "user terminal" and "remote controller" shall be synonymous and may refer to any device that may communicate with one or more casino servers, one or more gaming devices, one or more third-party service provider servers, one or more player devices, and/or other network nodes. User terminals may, for example, include personal computers, laptop computers, handheld computers, telephones, kiosks, automated teller machines, gaming devices, game consoles, and/or vending machines. They may include facilities to support secure communications using encryption or the like.

The terms "player device" and "user device" shall be synonymous and may refer to any device owned or used by a user or consumer capable of accessing and/or displaying online and/or offline content. Player devices may communicate with one or more casino servers, one or more gaming devices, one or more third-party service provider servers, one or more user terminals, and/or other network nodes. In some embodiments, player devices may, for example, include gaming devices, personal computers, personal digital assistants, point-of-sale terminals, point of display terminals, kiosks, telephones, cellular phones, automated teller machines (ATMs), pagers, and combinations of such devices.

The term "input device" may refer to a device that is used to receive an input. An input device may communicate with or be part of another device such as a point of sale terminal, a point of display terminal, a user terminal, a server, a player device, a gaming device (e.g., a pressure sensor in a "spin" button on a gaming device), a controller, etc. Some examples of input devices include: a "spin" or "deal" button and/or a handle on a gaming device, a bar-code scanner, a magnetic stripe reader, a computer keyboard, a point-of-sale terminal keypad, a touch-screen, a microphone, an infrared sensor, a sonic ranger, a computer port, a video camera, a motion detector, a digital camera, a network card, a universal serial bus (USB) port, a GPS receiver, a radio frequency identification (RFID) receiver, an RF receiver, a thermometer, a pressure sensor, and a weight scale.

The term "output device" may refer to a device that is used to output information. An output device may communicate with or be part of another device (e.g., a gaming device, a point of sale terminal, a point of display terminal, a player device, a casino device, a controller, etc.). Possible output devices include: a cathode ray tube (CRT) monitor, liquid crystal display (LCD) screen, light emitting diode (LED) screen, a printer, an audio speaker, an infra-red transmitter, a radio transmitter.

The terms "I/O device" and "input/output device" shall be synonymous and may refer to any combination of input and/or output devices.

The term "player tracking card" may refer to a device that may be capable of identifying and/or storing information about a consumer who is a casino player. Typically player tracking cards may be accessed by gaming devices and magnetic card readers operated by casino staff. The information stored on the player tracking card may include identifying information, as well as financial information, such as a number of gambling credits remaining. The card may be machine readable, for example, by a gaming device. According to some embodiments of the present invention, a player tracking card may store player and/or membership and/or player preference information such as a player's desired rate of play. Alternatively information on the card may merely be a pointer to information stored on a server.

The term "gross winnings" may refer to a player's total winnings for a session or time period, without regard to the amounts wagered during the session.

The term "net winnings" may refer to a player's total winnings for a session or time period, less the total amount wagered during that time period.

The term "parameter" may refer to a physical characteristic of a gaming device, its displayed text or graphics, its emitted sounds, or any aspect of the way in which a gaming device operates. For example, the amount of time the gaming device allows its reels to spin after a single handle pull is a parameter of the gaming device. The sensitivity of a button of the gaming device is another parameter. A third parameter is the volume at which the gaming device produces sound. A "game play" parameter may refer to a parameter related to a characteristic of a gaming device specific to the experience of playing the game of the gaming device. For example, the pace of the game may be considered a game play parameter, whereas the clock speed of the gaming device's processor would likely not be considered a game play parameter.

The term "maximum potential rate of play" may refer to a rate of play that could be achieved if a player took only the absolute minimum time necessary to initiate each play on a gaming device.

The terms "reel resolution" and "resolution" shall be synonymous and may refer to the perceptible actions of a gaming device that are displayed to give the perception that the gaming device is working to generate an outcome. Modern gaming devices typically use very fast processors to generate outcomes almost instantaneously. The sounds and displays typically presented by such gaming devices are not actually related to the generation of the outcomes. In an attempt to enhance the gaming experience, modern gaming devices may create the perception that the sounds and displays must complete or "resolve" before the outcome may finally be presented. These "reel resolution" actions (including sounds, displays, animations, flashing lights, etc.) by the gaming device typically take orders of magnitude longer to complete than the processor of the gaming device takes to generate an outcome. However, in early slot machines, the time it took for the reels to stop spinning (or to "resolve") was the time it took for the gaming device to generate an outcome. Reel resolution may refer to any actions or displays by the gaming device between the time a player initiates a handle pull and the gaming device displays the outcome. In video poker and/or video blackjack type games, resolution may refer to actions or displays presented while the player waits to see the cards he is dealt. In a bonus round, reel resolution may refer to actions or displays presented while the player watches computation of bonus points or other outcomes.

The terms "reel resolution time" or "resolution time" shall be synonymous and may refer to the time it takes between a handle pull and final presentation of the resulting outcome. Reel resolution time may be almost instantaneous or in the case of elaborate bonus round animations, for example, may take several minutes.

The terms "session," "gaming session," "gambling session," and "play session" shall be synonymous and may refer to a series of plays at one gaming device, a series of plays at multiple gaming devices, and/or a continuous period of time spent gambling in a casino location.

The terms "products," "goods," "merchandise," and "services" shall be synonymous and may refer to anything licensed, leased, sold, available for sale, available for lease, available for licensing, and/or offered or presented for sale, lease, or licensing including packages of products, subscriptions to products, contracts, information, services, and intangibles.

The term "merchant" may refer to an entity who may offer to sell, lease, and/or license one or more products to a consumer (for the consumer or on behalf of another) or to other merchants. For example, merchants may include sales agents, sales channels, individuals, companies, manufacturers, distributors, direct sellers, re-sellers, and/or retailers. Merchants may transact out of buildings including stores, outlets, malls, casinos, and warehouses, and/or they may transact via any number of additional methods including mail order catalogs, vending machines, online web sites, and/or via telephone marketing. Note that a producer or manufacturer may choose not to sell to customers directly and in such a case, a retailer may serve as the manufacturer's or producer's sales channel or agent.

B. System

Figure 2:
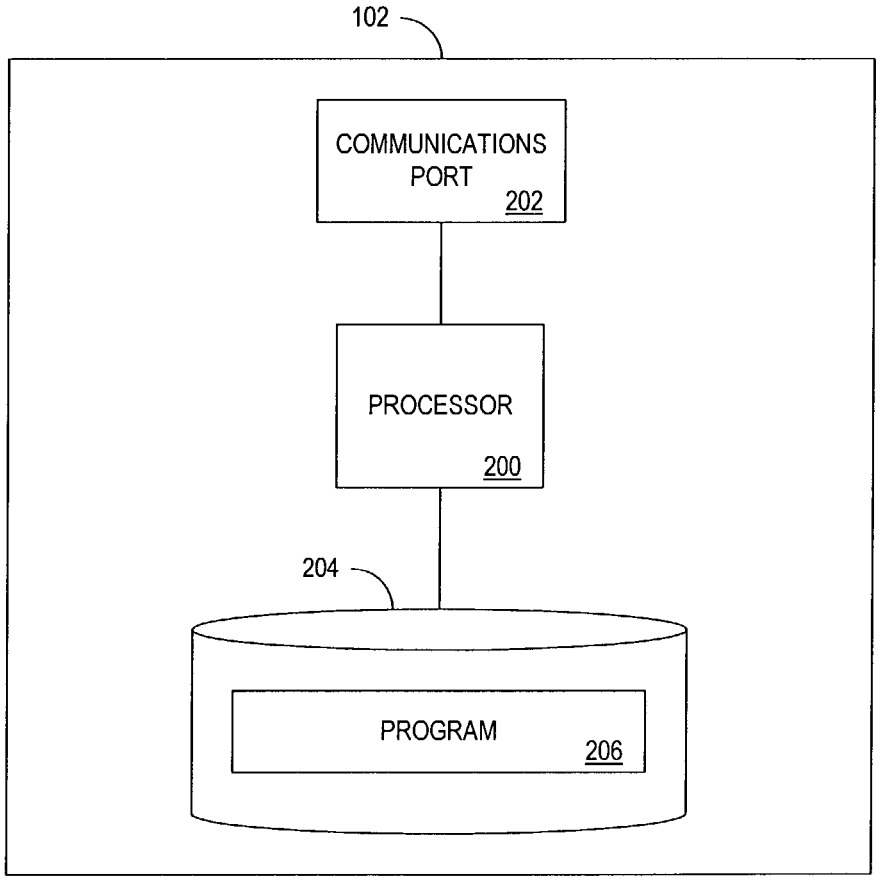
FIG. 2 is a block diagram illustrating an example of the details of a casino server 102 as depicted in FIG. 1 according to some embodiments of the present invention.
Figure 3:
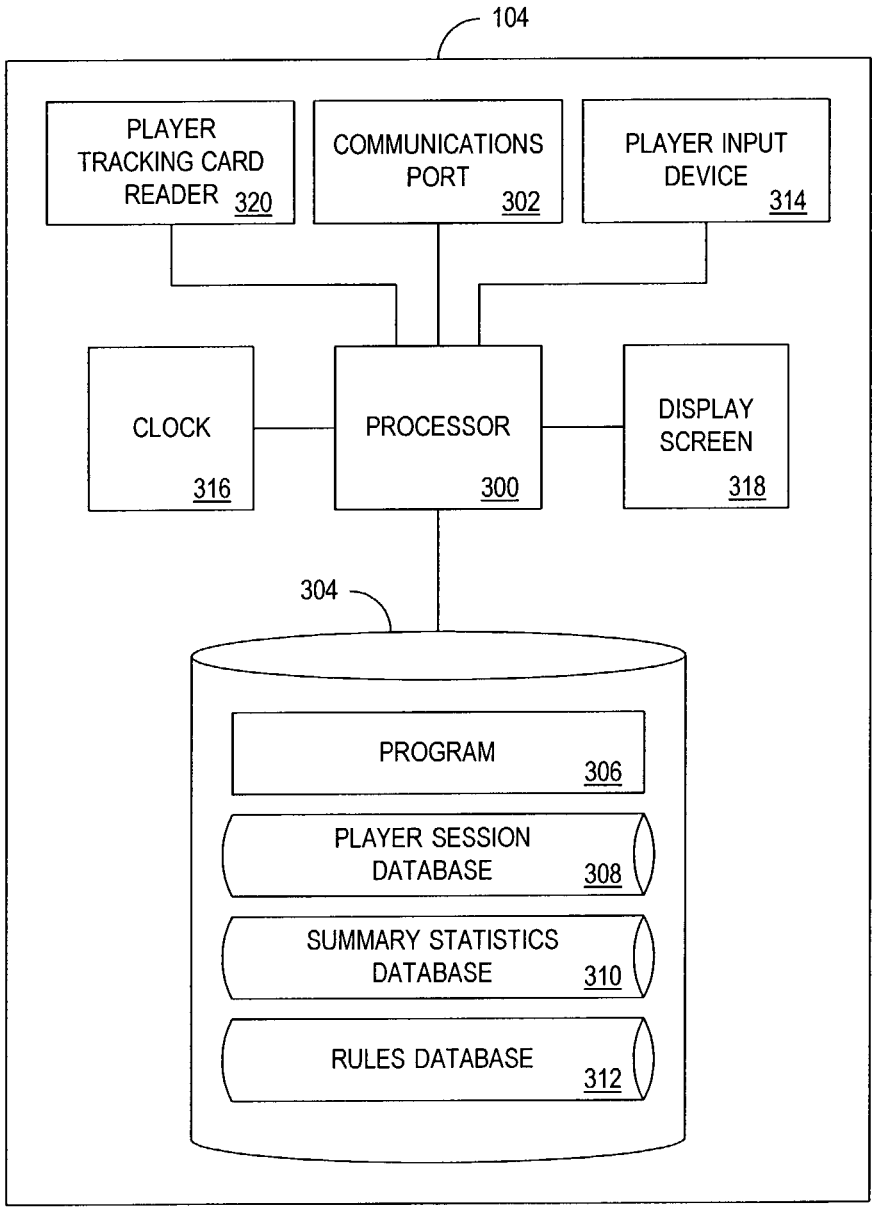
FIG. 3 is a block diagram illustrating an example of the details of a gaming device 104 as depicted in FIG. 1 according to some embodiments of the present invention.

An example embodiment of the system 100 of the present invention is depicted in FIG. 1. The system 100 according to some embodiments of the present invention may include one or more casino servers 102 (an example of which is depicted in FIG. 2) in one or two-way communication with one or more gaming devices 104 (an example of which is depicted in FIG. 3) via a network such as, for example, the Internet or via another communications link. Although not pictured, other casino devices besides gaming device 104 may be connected to the casino server 102. Likewise, servers of other casinos and other establishments may be in direct or indirect communication with the casino server 102. Note that in some embodiments, the system may consist of only a gaming device 104.

In operation, the casino server 102 may function under the control of a casino, merchant, or other entity that may also control use of the gaming devices 104. For example, the casino server 102 may be a server in a merchant's network. In some embodiments, the casino server 102 may also be a merchant's server.

In the embodiment pictured in FIG. 1, communication between the casino server 102, the gaming devices 104, and/or third-party servers (not pictured), may be direct and/or via a network such as the Internet. Each of the casino server 102 and the gaming devices 104 may comprise, for example, computers, such as those based on the Intel® Pentium® or Centrino™ processor, that are adapted to communicate with each other. Any number of third-party servers (not pictured), external casino servers (not pictured), and/or gaming devices 104 may be in direct or indirect, one or two-way communication with the casino server 102. The casino server 102 and/or the gaming devices 104 may each be physically proximate to each other or geographically remote from each other. The casino server 102 and/or the gaming devices 104 may each include input/output devices.

As indicated above, communication between the casino server 102 and the gaming devices 104 may be direct or indirect, such as over an Internet Protocol (IP) network such as the Internet, an intranet, or an extranet through a web site maintained by the casino server 102 (and/or a third-party server) on a remote server or over an online data network including commercial on-line service providers, bulletin board systems, routers, gateways, and the like. In some embodiments, the nodes may communicate with each other over local area networks including any combination of Ethernet, Token Ring, FDDI Full Duplex Technology (FFDT), and the like, radio frequency communications, infrared communications, microwave communications, cable television systems, satellite links, Wide Area Networks (WAN), Asynchronous Transfer Mode (ATM) networks, Public Switched Telephone Network (PSTN), other wireless networks, and the like.

Those skilled in the art will understand that devices in communication with each other need not be continually transmitting to each other. On the contrary, such devices need only transmit to each other as necessary, and may actually refrain from exchanging data most of the time. For example, a device in communication with another device via the Internet may not transmit data to the other device for weeks or months at a time.

The casino server 102 (and/or a third-party server) may function as a "Web server" that presents and/or generates Web pages which are documents stored on Internet-connected computers accessible via the World Wide Web using protocols such as, e.g., the hyper-text transfer protocol ("HTTP"). Such documents typically include one or more hyper-text markup language ("HTML") files, associated graphics, sound, and script files. A Web server allows communication with the casino server 102 in a manner known in the art. The gaming devices 104 may use a web browser, such as NAVIGATOR® published by NETSCAPE® for accessing HTML forms generated or maintained by or on behalf of the casino server 102 and/or a third-party server.

As indicated above, any or all of the casino server 102, a third-party server, and/or the gaming devices 104 may include or be part of, e.g., processor based cash registers, telephones, interactive voice response (IVR) systems such as the ML400-IVR designed by MISSING LINK INTERACTIVE VOICE RESPONSE SYSTEMS, cellular/wireless phones, vending machines, pagers, gaming devices including slot machines, personal computers, portable types of computers, such as a laptop computer, a wearable computer, a palmtop computer, a hand-held computer, a smart card, and/or a Personal Digital Assistant ("PDA"). Further details of the casino server 102 and the gaming devices 104 are provided below with respect to FIGS. 2 through 4.

As indicated above, in some embodiments of the invention, the casino server 102 (and/or a third-party server) may include gaming devices 104. In addition, the casino server 102 may communicate with users directly instead of through the gaming devices 104. Although not pictured, the casino server 102, a third-party server, and/or the gaming devices 104 may also be in communication with one or more consumer and/or merchant credit institutions to effect currency transactions and may do so directly or via a secure financial network such as the Fedwire network maintained by the United States Federal Reserve System, the Automated Clearing House (ACH) Network, the Clearing House Interbank Payments System (CHIPS), or the like.

In operation, the gaming devices 104 (and/or a third-party server) may exchange information about the use of the gaming devices 104 by individual players, data about the players, and the like. In embodiments with a third-party server, the casino server 102 and/or the gaming devices 104 may exchange information about the use of the gaming devices 104 by individual players, data about the players, and the like via the third-party server. The gaming devices 104 may, for example, provide information related to the force with which a player presses the gaming devices' buttons to the casino server 102 (and/or a third-party server). The gaming devices 104 may further provide gambling performance and behavior data to the casino server 102 (and/or a third-party server). The casino server 102 (and/or a third-party server) may provide historical information about a player to the gaming devices 104 in the casino location or to remote gaming devices.

C. Devices

FIG. 2 is a block diagram illustrating details of an example of the casino server 102 of FIG. 1 (and/or an example of a third-party server). The casino server 102 is operative to manage the system 100 and execute the methods of the present invention. The casino server 102 may be implemented as one or more system controllers, one or more dedicated hardware circuits, one or more appropriately programmed general purpose computers, or any other similar electronic, mechanical, electro-mechanical, and/or human operated device.

The casino server 102 (and/or a third-party server) may include a processor 200, such as one or more Intel® Pentium® processors. The processor 200 may include or be coupled to one or more clocks or timers (not pictured) and one or more communication ports 202 through which the processor 200 communicates with other devices such as the gaming devices 104 and/or a third-party server. The processor 200 is also in communication with a data storage device 204. The data storage device 204 may include any appropriate combination of magnetic, optical and/or semiconductor memory, and may include, for example, additional processors, communication ports, Random Access Memory ("RAM"), Read-Only Memory ("ROM"), a compact disc and/or a hard disk. The processor 200 and the storage device 204 may each be, for example: (i) located entirely within a single computer or other computing device; or (ii) connected to each other by a remote communication medium, such as a serial port cable, a LAN, a telephone line, radio frequency transceiver, a fiber optic connection or the like. In some embodiments for example, the casino server 102 may comprise one or more computers (or processors 200) that are connected to a remote server computer operative to maintain databases, where the data storage device 204 is comprised of the combination of the remote server computer and the associated databases.

The data storage device 204 stores a server program 206 for controlling the processor 200. The processor 200 performs instructions of the server program 206, and thereby operates in accordance with the present invention, and particularly in accordance with the methods described in detail herein. The present invention may be embodied as a computer program developed using an object oriented language that allows the modeling of complex systems with modular objects to create abstractions that are representative of real world, physical objects and their interrelationships. However, it would be understood by one of ordinary skill in the art that the invention as described herein can be implemented in many different ways using a wide range of programming techniques as well as general purpose hardware systems or dedicated controllers. The server program 206 may be stored in a compressed, uncompiled and/or encrypted format. The server program 206 furthermore may include program elements that may be generally useful, such as an operating system, a database management system and device drivers for allowing the processor 200 to interface with computer peripheral devices. Appropriate general purpose program elements are known to those skilled in the art, and need not be described in detail herein.

Further, the server program 206 is operative to execute a number of invention-specific, objects, modules and/or subroutines which may include (but are not limited to) one or more routines to identify a player at a gaming device 104; one or more routines to receive information about a user; one or more routines to assess the mood of a player; one or more routines to send signals to a gaming device 104 to adjust a parameter; one or more routines for receiving information from a gaming device 104; one or more routines to store player performance information; one or more routines to store player preference information; one or more routines to facilitate and control communications between gaming devices 104 and/or third-party servers; one or more routines to restore a gaming device 104 to using its default parameter values; and/or one or more routines to control databases or software objects that track information regarding users, casinos, merchants supplying prizes, other third-parties, gambling results, gaming devices 104 and awarding prizes. Examples of these routines and their operation are described in detail below in conjunction with the flowchart depicted in FIGS. 8 and 9.

According to some embodiments of the present invention, the instructions of the server program 206 may be read into a main memory of the processor 200 from another computer-readable medium, such from a ROM to a RAM. Execution of sequences of the instructions in the server program 206 causes processor 200 to perform the process steps described herein. In alternative embodiments, hard-wired circuitry or integrated circuits may be used in place of, or in combination with, software instructions for implementation of the processes of the present invention. Thus, embodiments of the present invention are not limited to any specific combination of hardware, firmware, and/or software.

Turning to FIG. 3, a block diagram depicting an exemplary gaming device 104 may include a processor 300 coupled to a communications port 302, a data storage device 304, a player input device 314, a clock 316, a display screen 318, and/or a player tracking card reader 320. Although not pictured, the player input device 314 may include a pressure sensor, which may also be coupled to the processor 300, for measuring force used when a player provides input to the gaming device 104. A pressure sensor may include any number of different types of strain gages that measure an amount of deflection (and/or a change in electrical resistance) of an elastic element as it is stretched or compressed, as are well known in the art. Such pressure sensors are operable to generate a signal that may be transmitted to the processor 300 and interpreted as representative of an amount of force applied to the attached player input device measured, for example, in Newtons.

The data storage device 304 stores a gaming device program 306 (hereinafter "program 306") for controlling the processor 300. The processor 300 performs instructions of the program 306, and thereby operates in accordance with the present invention, and particularly in accordance with the methods described in detail herein. As with the casino server program 206 described above, the program 306 may be embodied as a computer program developed using an object oriented language that allows the modeling of complex systems with modular objects to create abstractions that are representative of real world, physical objects and their interrelationships. However, it would be understood by one of ordinary skill in the art that the invention as described herein can be implemented in many different ways using a wide range of programming techniques as well as general purpose hardware systems or dedicated controllers. The program 306 may be stored in a compressed, uncompiled and/or encrypted format. The program 306 furthermore may include program elements that may be generally useful, such as an operating system, a database management system and device drivers for allowing the processor 300 to interface with computer peripheral devices. As stated above, appropriate general purpose program elements are known to those skilled in the art, and need not be described in detail herein.

Further, as with the server program 206 described above, the program 306 may be operative to execute a number of invention-specific, objects, modules and/or subroutines which may include (but are not limited to) one or more routines to identify a player at the gaming device 104; one or more routines to receive information about a user; one or more routines to assess the mood of a player; one or more routines to implement rules regarding adjusting parameters; one or more routines to adjust parameters; one or more routines to receive signals from a casino server 102 to adjust parameters; one or more routines to send information to a casino server 102; one or more routines to store player performance information; one or more routines to store player preference information; one or more routines to facilitate and control communications between the gaming device 104 and/or third-party servers; one or more routines to restore the gaming device 104 to using its default parameter values; and/or one or more routines to control databases or software objects that track information regarding users, casinos, merchants supplying prizes, other third-parties, gambling results, other gaming devices, and awarding prizes. Examples of these routines and their operation are described in detail below in conjunction with the flowchart depicted in FIGS. 8 and 9.

As with the server program 206, according to some embodiments of the present invention, the instructions of the program 306 may be read into a main memory of the processor 300 from another computer-readable medium, such from a ROM to a RAM. Execution of sequences of the instructions in the program 306 causes processor 300 to perform the process steps described herein. In alternative embodiments, hard-wired circuitry or integrated circuits may be used in place of, or in combination with, software instructions for implementation of the processes of the present invention. Thus, embodiments of the present invention are not limited to any specific combination of hardware, firmware, and/or software.

In addition to the program 306, the storage device 304 is also operative to store (i) a player session database 308, (ii) a summary statistics database 310, and (iii) a rules database 312. The databases 308, 310, 312 are described in detail below and example structures are depicted with sample entries in the accompanying figures.

As will be understood by those skilled in the art, the schematic illustrations and accompanying descriptions of the sample databases presented herein are exemplary arrangements for stored representations of information. Any number of other arrangements may be employed besides those suggested by the tables shown. For example, even though three separate databases are illustrated, the invention could be practiced effectively using one, two, four, five, or more functionally equivalent databases. Similarly, the illustrated entries of the databases represent exemplary information only; those skilled in the art will understand that the number and content of the entries can be different from those illustrated herein. Further, despite the depiction of the databases as tables, an object-based model could be used to store and manipulate the data types of the present invention and likewise, object methods or behaviors can be used to implement the processes of the present invention. These processes are described below in detail with respect to FIGS. 8 and 9.

Although the databases 308, 310, 312 are depicted as residing on the gaming device 104, it should be understood that these databases 308, 310, 312 could just as easily be implemented on the casino server 102. Likewise, a casino server 102 may store a redundant copy of the gaming devices' databases 308, 310, 312 to protect against data loss or for any number of other reasons. In embodiments in which, for example, the casino server 102 serves/controls multiple casinos operated by different entities, a casino may wish to have a local copy of the portions of the databases 308, 310, 312 that include entries related to that casino and exclude other casinos' access to that casino's information. Thus, in some embodiments of a gaming device 104 according to the present invention there may be included local copies of some portions of the databases 308, 310, 312. Such a redundant configuration may provide enhanced system performance by reducing network communications. A program 306 may include one or more routines to respond to requests from other gaming devices for player session data, player preference data, and player performance information. Such a distributed configuration may provide enhanced system security by allowing different casinos to store and maintain their own databases. In some embodiments, local versions of the databases 308, 310, 312 are not stored on the gaming devices 104 at all and instead, the gaming device program 306 accesses casino server databases (that are equivalent to databases 308, 310, 312) which are stored and maintained on the casino server 102. Likewise, in some embodiments, the databases may only exist on a third-party server and thus, both the casino server 102 and the gaming devices 104 may access a third-party server for the data.

Figure 4:
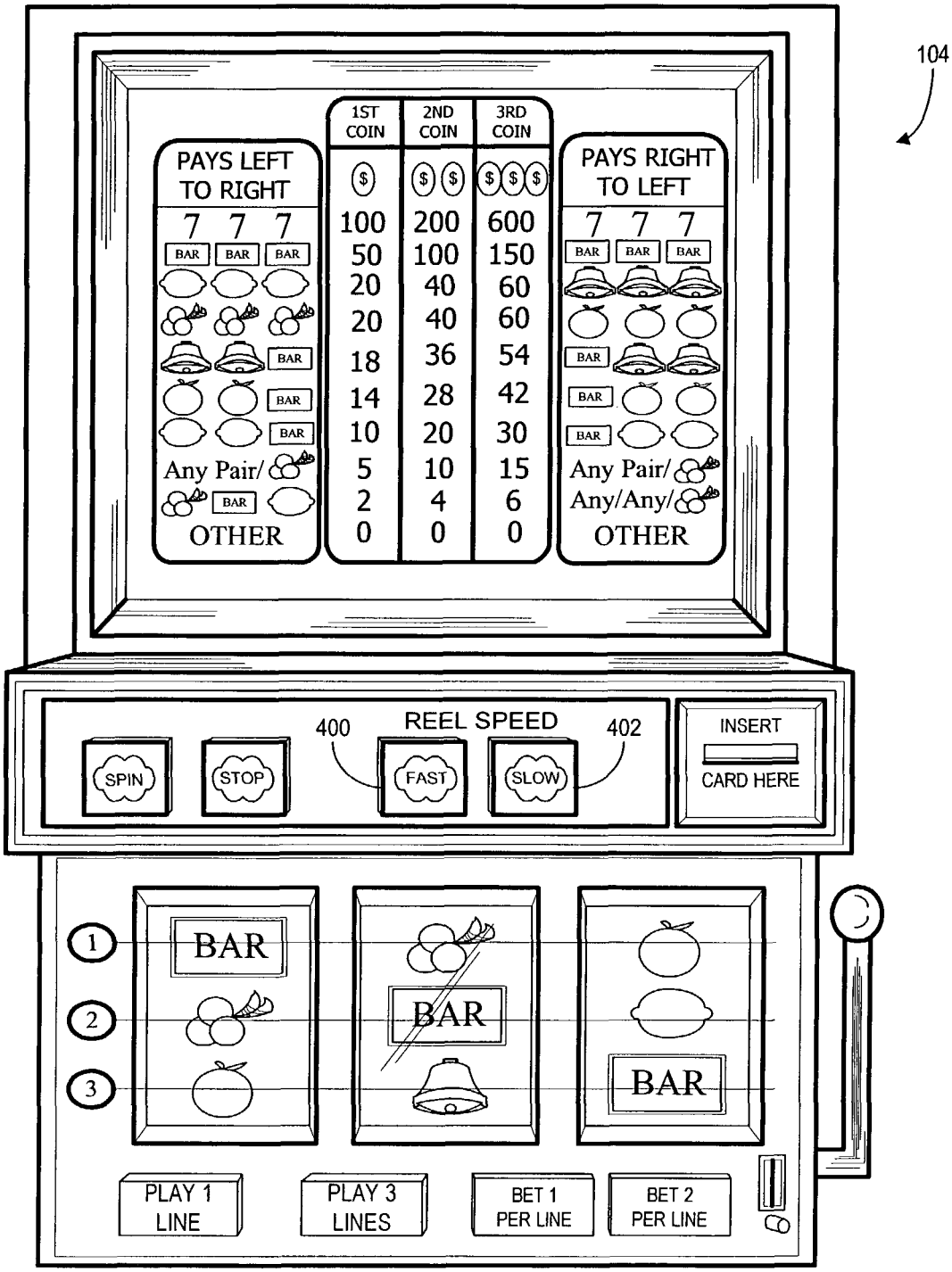
FIG. 4 is a diagram illustrating an example of the external appearance of a gaming device 104 as depicted in FIG. 1 according to some embodiments of the present invention.

Turning to FIG. 4, an illustration of an example of the exterior of a gaming device 104 according to some embodiments of the present invention is depicted. In some embodiments, the player input device 314 may include reel speed buttons 400, 402. A faster reel speed button 400 and a slower reel speed button 402 on a gaming device 104 may be provided to allow a player to indicate a desire to adjust the reel resolution time. In some embodiments, the reel speed buttons 400, 402 may only be enabled at certain times. For example, in some embodiments, the slower reel speed button 402 may have no effect until the player has first pressed the faster reel speed button 400. In some embodiments, the reel speed buttons 400, 402 may only be enabled for player use while the reels are spinning, a video poker hand is being dealt, and/or a bonus round is being played out. In some embodiments, the reel speed buttons 400, 402 may only be enabled after the gaming device 104 determines that the player perceives that the gaming device 104 is in a cold period and/or after the gaming device 104 determines that the player has become frustrated.

Note that although the reel speed buttons 400, 402 may be implemented so as to make it appear that the speed at which reels are spinning is being altered, the reels may simply spin a fewer number of revolutions per handle pull. In some embodiments, the reels may actually spin the same number of revolutions within a shorter amount of time.

D. Databases

As indicated above, it should be noted that although the example embodiment depicted in FIG. 3 includes three particular databases stored in storage device 304, other database arrangements may be used which would still be in keeping with the spirit and scope of the present invention. In other words, the present invention could be implemented using any number of different database files or data structures, as opposed to the three depicted in FIG. 3. Further, the individual database files could be stored on different devices (e.g., located on different storage devices in different geographic locations, such as on a server). Likewise, the programs 206, 306 could also be located remotely from the storage devices 204, 304 and/or on another server. As indicated above, the programs 206, 306 may include instructions for retrieving, manipulating, and storing data in the databases 308, 310, 312, as may be useful in performing the methods of the invention as will be further described below.

1. Player Session Database

Turning to FIG. 5, a tabular representation of an embodiment of a player session database 208 according to some embodiments of the present invention is illustrated. This particular tabular representation of a player session database 308 includes twelve consecutive sample records or entries which each include information regarding a particular action of a gaming device 104 or action by a player at the gaming device 104. In some embodiments of the invention, a player session database 308 is used to track events and information about events including coin insert times, button depression and release times and force used, reel spin start and stop times, outcomes, payout beginning and ending times, and parameter adjustment times. Those skilled in the art will recognize that such a player session database 308 may include any number of entries or additional fields.

The particular tabular representation of a player session database 308 depicted in FIG. 5 includes two summary fields and, for each of the entries or records, three other fields. The summary fields may include: (i) a player identifier field 500 that may store a representation uniquely identifying the player using the gaming device; and (ii) a player name field 502 that may store a representation of the player's name. The three other fields may include (i) a time field 504 that may store a representation of the time an event took place; (ii) an event field 506 that may store a description of an event; and (iii) a details field 508 that may store further information regarding the associated event.

The example player session database 308 depicted in FIG. 5 provides example data to illustrate the meaning of the information stored in this database embodiment. A player identifier 500 (e.g., "AP1111-23") may be used to identify and index players listed in the player session database 308. In this example, "AP1111-23" identifies a player named "Sam Brown" as indicated by the player name field 502.

Twelve examples of events spanning less than ten seconds of Sam Brown's play session are provided. At "1:26:02.83 AM," one coin is inserted into the gaming device 104 (row 510). Less than one second later, the "Play 3 Lines" button is depressed with a force of two Newtons (row 512) and then released, one-third of a second later (row 514). Less than one second after that, the "Bet 1 per line" button is depressed with four times as much force as was used to press the "Play 3 Lines" button (row 516). Within half of a second, the "Bet 1 per line" button is released (row 518) and within 19 hundredths of a second, the reels begin spinning (row 520). While the reels are still spinning, Sam Brown, relatively lightly, depresses (row 522) and releases (row 524) the "Bet 1 per line" button. Approximately three seconds after they began spinning, the reels resolve/stop spinning (row 526) and display a winning cherry-bar-bell outcome (see FIG. 4). Within half of a second, a two coin payment begins (row 528) and completes approximately half a second later (row 530). After another half of a second passes, new wager inputs are permitted to be entered (row 532).

The significance of these example events recorded during a sample play session are discussed in more detail below, however, one may note that in this example the player pressed the "Bet 1 per line" button with extra force and unnecessarily during the reel resolution. Such events may be interpreted to mean that the player may be becoming frustrated with the rate of play. Combined with other information, the program 306 may determine that the reel resolution time of the gaming device 104 should be shortened in an attempt to alleviate the player's frustration.

2. Summary Statistics Database

Figure 6:
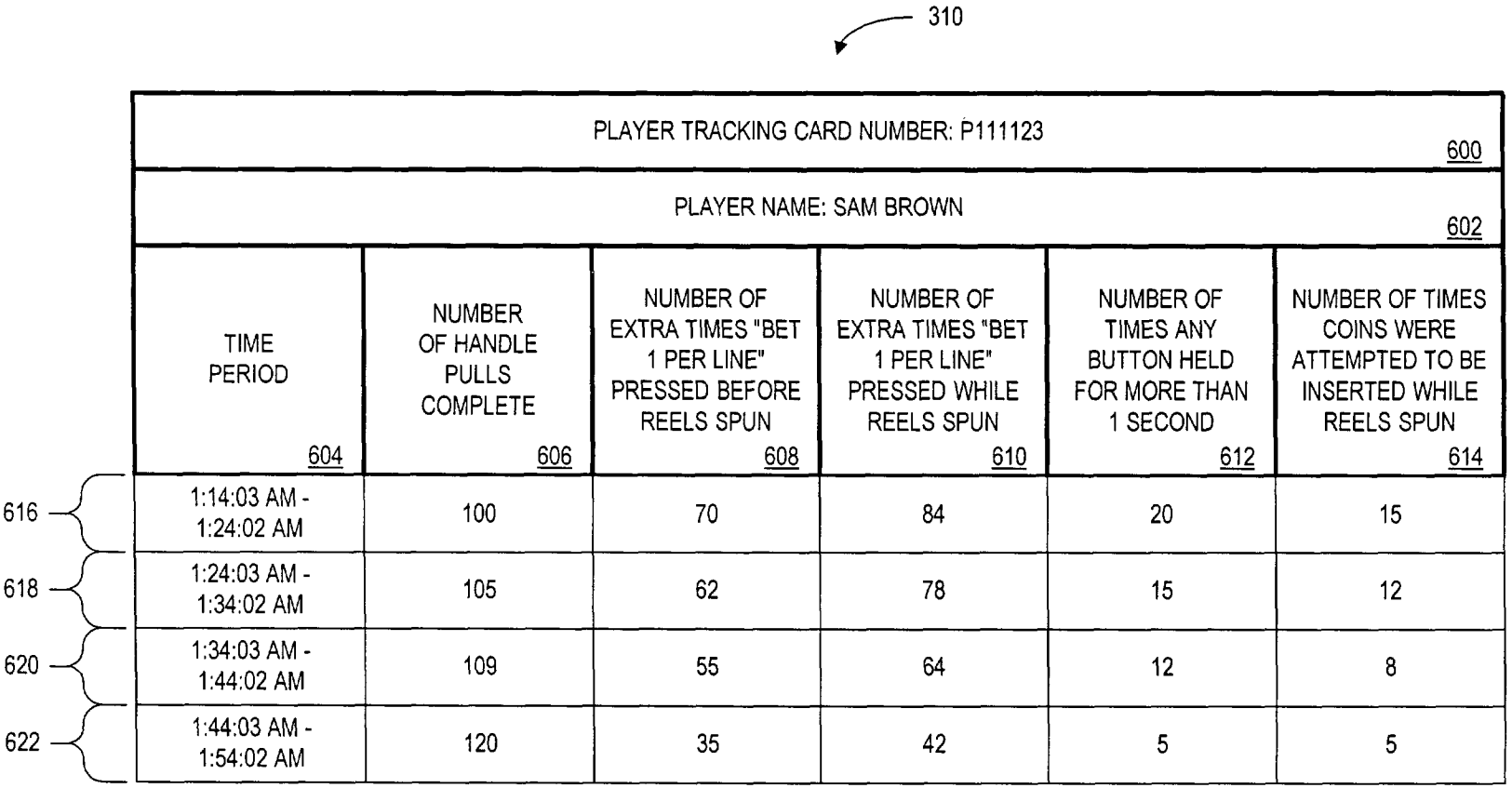
FIG. 6 is a table illustrating an example data structure of an example summary statistics database 310 as depicted in FIG. 3 for use in some embodiments of the present invention.

Turning to FIG. 6, a tabular representation of an embodiment of a summary statistics database 310 according to some embodiments of the present invention is illustrated. This particular tabular representation of a summary statistics database 310 includes four sample records or entries which each include summary information regarding different time periods of a play session. In some embodiments of the invention, a summary statistics database 310 is used to track such things as number of handle pulls, number of extra button presses, number of times buttons are held down for more than a normal amount of time, the number of times buttons are pressed harder than normal, and the number of times attempts are made to insert coins during reel resolution. Those skilled in the art will recognize that such a summary statistics database 310 may include any number of entries or additional fields.

The particular tabular representation of a summary statistics database 310 depicted in FIG. 6 includes two summary fields and, for each of the entries or records, six other fields. The summary fields may include: (i) a player tracking card number field 600 that may store a representation uniquely identifying the player using the gaming device; and (ii) a player name field 602 that may store a representation of the player's name.

The six other fields may include (i) a time period field 604 that may store a representation identifying a time period during the gaming session; (ii) a "number of handle pulls complete" field 606 that may store a representation of the number of handle pulls completed during the time period; (iii) a "number of extra times 'Bet 1 per line' pressed before reels spun" field 608 that may store a representation of the number of extra times the "Bet 1 per line" button was pressed before the reels began spinning during the time period; (iv) a "number of times 'Bet 1 per line' pressed while reels spun" field 610 that may store a representation of the number of times the "Bet 1 per line" button was pressed while the reels were still spinning during the time period; (v) a "number of times any button held for more than one second" field 612 that may store a representation of the number of times any button on the gaming device 104 was held for more than one second during the time period; and (vi) a "number of times coins were attempted to be inserted while reels spun" field 614 that may store a representation of the number of times coins were attempted to be inserted while the reels were still spinning during the time period.

The example summary statistics database 310 depicted in FIG. 6 provides example data to illustrate the meaning of the information stored in this database embodiment. A player tracking card number (e.g., "P111123") may be used to identify and index players listed in the summary statistics database 310. In this example, "P111123" identifies a player named "Sam Brown" as indicated by the player name field 602. In this example, statistics regarding four, sequential, ten minute periods during Sam Brown's gambling session are summarized. In the first period (row 616), only one hundred handle pulls were completed and the player pressed the "Bet 1 per line" button a total of seventy extra times before the reels began to spin and eighty-four extra times while the reels spun. Twenty times during the ten minute period the player held a button for more than a second and fifteen times he tried to insert more coins while the reels spun. Although not directly evident from the example data in the summary statistics database 310, during the next thirty minutes (rows 618, 620, 622), the gaming device 104 adjusted parameters in response to the summary statistics. The effects of the adjustment are, however, directly evident in the statistics. The number of handle pulls steadily increased from one hundred pulls per ten minutes to 120 pulls per ten minutes, the number of extra button pushes decreased by half, the number of times the buttons were held more than one second decreased by seventy-five percent, and the number of times the player attempted to insert coins prematurely decreased by sixty-six percent.

3. Rules Database

Turning now to FIG. 7, a tabular representation of an embodiment of a rules database 312 according to some embodiments of the present invention is illustrated. This particular tabular representation of a rules database 312 includes sample records or entries which each include information regarding the details of a rule used in determining when and how much to adjust a gaming device parameter. In some embodiments of the invention, a rules database 312 may specify that when certain predefined thresholds are met or exceeded, parameters such as reel resolution time, payment time, and button sensitivity are adjusted. The predefined thresholds may include a certain number of excess button presses, a certain amount of force used to press buttons or pull handles, a certain amount of time between button presses, and a certain length of time buttons are held down. Those skilled in the art will recognize that such a rules database 312 may include any number of entries or additional fields.

The particular tabular representation of a rules database 312 depicted in FIG. 7 includes six fields for each of the entries or records. The fields may include: (i) a "number of excess times 'spin' pressed" field 700 that may store a representation of the threshold number of excess times the "spin" button must be pressed, during a defined period, before the action listed in the corresponding "action" field 710 will be taken;

(ii) a "number of times 'stop' pressed while reels still spinning" field 702 that may store a representation of the threshold number of times the "stop" button must be pressed while the reels are still spinning, during a defined period, before the action listed in the corresponding "action" field 710 will be taken;

(iii) an "average length of time between when 'spin' and 'stop' pressed" field 704 that may store a representation of the threshold amount of time between the "spin" and "stop" buttons being pressed that must be met or exceeded, during a defined period, before the action listed in the corresponding "action" field 710 will be taken;

(iv) a "number of times any button held for more than 1 second" field 706 that may store a representation of the threshold number of times any button is held for more than a second that must be met or exceeded, during a defined period, before the action listed in the corresponding "action" field 710 will be taken;

(v) a "current time of reel resolution" field 708 that may store a representation of a threshold reel resolution time of the gaming device 104 that must currently be met or exceeded before the action listed in the corresponding "action" field 710 will be taken; and (vi) an "action" field 710 that may store a representation of a magnitude and type of adjustment to a parameter of the gamming device 104 that will be made if all of the thresholds of each of the corresponding fields 700, 702, 704, 706, 708 are met or exceeded.

The example rules database 312 depicted in FIG. 7 provides example data to illustrate the meaning of the information stored in this database embodiment. The example data provides five example rules.

The first example rule (row 712) provides that if during a predefined sampling period (e.g., 10 minutes) any button is held down for more than one second, ten or more times, then the sensitivity of all buttons is to be increased by five percent.

The second example rule (row 714) provides that if during a predefined sampling period (e.g., 10 minutes) the "spin" button is pressed ten or more extra times, then the sensitivity of the "spin" button is to be increased by five percent.

The third example rule (row 716) provides that if during a predefined sampling period (e.g., 10 minutes) the "spin" button is pressed ten or more extra times; and the "stop" button is pressed ten or more times while the reels are still spinning; and the reel resolution time is currently set to take one second or longer, then the reel resolution time is to be reduced by 0.1 seconds.

The fourth example rule (row 718) provides that if during a predefined sampling period (e.g., 10 minutes) the "spin" button is pressed ten or more extra times; and the "stop" button is pressed ten or more times while the reels are still spinning; and the average length of time between the "spin" button and the "stop" button being pressed is 0.7 seconds or less; and the reel resolution time is currently set to take one second or longer, then the reel resolution time is to be reduced by 0.2 seconds.

The fifth example rule (row 720) provides that if during a predefined sampling period (e.g., 10 minutes) the "spin" button is only pressed two or less extra times; and the "stop" button is only pressed two or less times while the reels are still spinning; and the reel resolution time is currently set to take two seconds or less, then the reel resolution time is to be increased by 0.1 seconds.

E. Process Descriptions

The system discussed above, including the hardware components and the databases, are useful to perform the methods of the invention. However, it should be understood that not all of the above described components and databases are necessary to perform any of the present invention's methods. In fact, in some embodiments, none of the above described system is required to practice the present invention's methods. The system described above is an example of a system that would be useful in practicing the invention's methods. For example, the summary statistics database 310 described above with respect to FIG. 6 is useful for tracking, aggregating, and analyzing information about a player's experience over a long period of time, but it is not absolutely necessary to have such a database in order to perform the methods of the invention. In other words, the methods described below may be practiced using, for example, counters directly coupled to rules logic that alters gaming device parameters directly.

Figure 8:
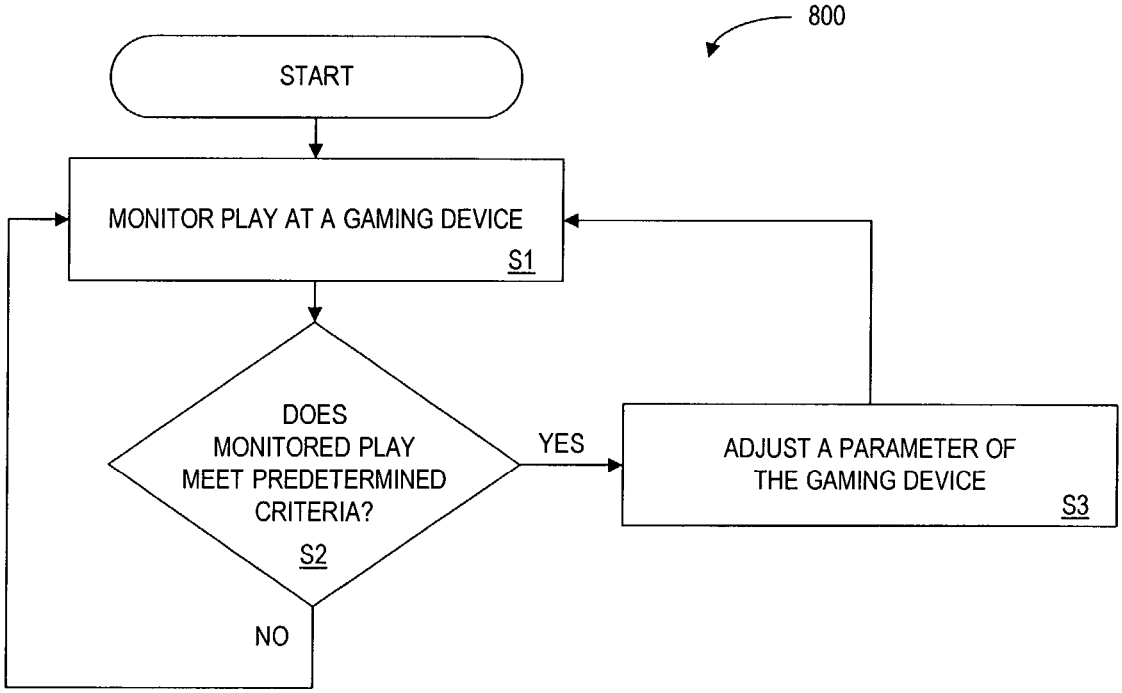
FIG. 8 is a flow diagram illustrating a first exemplary process for optimizing the rate of play of a gaming device according to and for use in some embodiments of the present invention.
Figure 9:
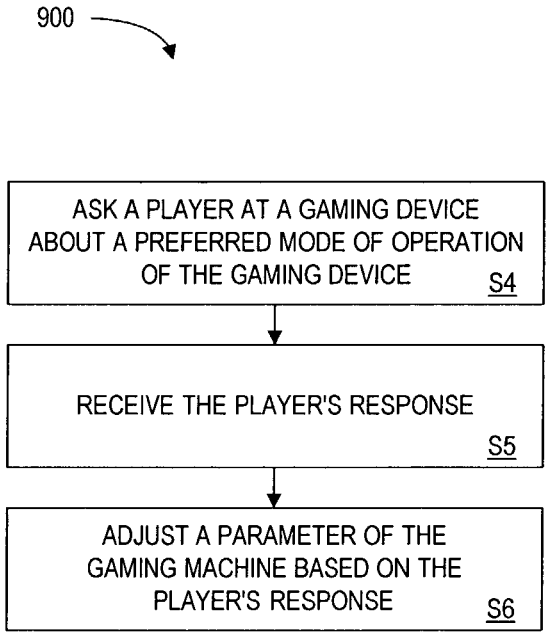
FIG. 9 is a flow diagram illustrating a second exemplary process for optimizing the rate of play of a gaming device according to and for use in some embodiments of the present invention.

Referring to FIGS. 8 and 9, flow charts are depicted that represent some embodiments of the present invention that may be performed by the casino server 102, a gaming device 104, and/or the casino. It must be understood that the particular arrangement of elements in the flow charts of FIGS. 8 and 9, as well as the number and order of example steps of various methods discussed herein, is not meant to imply a fixed order, sequence, quantity, and/or timing to the steps; embodiments of the present invention can be practiced in any order, sequence, and/or timing that is practicable. Likewise, the labels used to reference the individual steps of the methods are not meant to imply a fixed order, sequence, quantity, and/or timing to the steps. In other words, for example, Step S2 may be followed by Step S1 in some situations and Step S3 in others.

In general terms and referring to FIG. 8, method steps of an embodiment of the present invention may be summarized as follows. In Step S1, play at a gaming device 104 is monitored. In Step S2, it is determined if the monitored play meets predetermined criteria. In Step S3, a gaming device parameter may be adjusted based upon the outcome of the determination made in Step S2.

Turning to FIG. 9, method steps of a second embodiment of the present invention may be summarized as follows. In Step S4, a player at a gaming device 104 is asked about a preferred mode of operation of the gaming device 104. In Step S5, the player's response is received. In Step S6, a parameter of the gaming device is adjusted based upon the player's response.

In the subsections that follow, each of these steps will now be discussed in greater detail. Note that not all of these steps are required to perform the methods of the present invention and that additional and/or alternative steps are also discussed below. Also note that the above general steps represent features of only some of the embodiments of the present invention and that they may be combined and/or subdivided in any number of different ways so that methods of the present invention include more or fewer actual steps. For example, in some embodiments many additional steps may be added to update and maintain the databases described above, but as indicated, it is not necessary to use the above described databases in all embodiments of the invention. In other words, the methods of the present invention may contain any number of steps that are practicable to implement the several different inventive processes described herein.

1. Automated Embodiments

In some embodiments of the present invention, the system 100 attempts to determine how to adjust gaming device parameters automatically in an effort to optimize the rate of play and other parameter settings of the gaming device. The system 100 makes observations and then deductions based on the observations and other information. Based on the deductions, adjustments are made. The system 100 then observes again, makes further deductions, and further adjustments if needed. In some embodiments the system 100 may loop through these steps continuously for as long as the player's gambling session continues. The details of these three steps are now discussed in depth.

(a) Monitor Play at a Gaming Device

In Step S1, play at a gaming device 104 is monitored. The gaming device 104 may record various aspects of such monitored play in a player session database 308 such as that depicted in FIG. 5. The gaming device 104 may monitor the player's play during any contiguous or non-contiguous time period during the player's duration of play and/or play sessions.

The following exemplary time line describing exemplary player actions and events surrounding a single handle pull for a physical reel machine is provided in conjunction with FIG. 5 to illustrate how play at a gaming device may be monitored in some embodiments of the present invention. Note that this description includes more detail and alternative embodiments than the discussion provided above with respect to the example embodiment of a player session database 308.

A player commences play at a gaming device 104 by inserting coins or bills, by accessing a stored account, and/or by transferring credit to the device.

Next the player designates a number of pay lines to be enabled. On some gaming devices 104, a player may enable anywhere from one to three pay lines, whereas on other gaming devices 104, a player might enable anywhere from one to fifteen pay lines. To enable pay lines, the player may press buttons on the gaming device 104 with such markings as "3 Lines" or "5 Lines."

Next, the player designates a wager size. For instance, the player may press "Bet 1" or "Bet Max Coins" or other such buttons of the gaming device 104. If the player has previously designated multiple pay lines, then the wager size may be on a per-line basis or may be a total wager size. For instance, if the player has enabled three pay lines and has indicated a wager of two coins per line, then the player's total wager for the handle pull is now six coins. Alternatively, if the player has previously enabled three out of a possible nine pay lines, and later hits "Bet Max Coins", then the player's bet would automatically be based on nine pay lines, and would be the same as if the player had previously enabled a number of pay lines other than three.

Next, the player initiates the handle pull by, for example, pressing a "Spin" button or pulling the handle of the gaming device 104.

Following the initiation of the handle pull, the reels spin for some period of time. At some point, the reels stop spinning, and the player can plainly see the outcome he has achieved. The outcome is said to have resolved.

Following the resolution of the outcome, there is a period of time during which coins or other payment are awarded to the player based on his outcome. If the player has not won anything, then there may still be a time period during which the player may take no action. This time period of inaction would reduce the possibility of a player's initiating a subsequent handle pull before fully comprehending the outcome he had just achieved.

Finally, the player may repeat the process, by designating a number of pay lines, designating a wager size, and so on.

There are, of course, many variations to the time line described above. For example, a player need not explicitly enable a certain number of pay lines, nor designate a specific wager size on each handle pull, as prior designations made by the player may be reused as default designations. Designating a wager size may, in some cases, automatically initiate the spinning of the reels, without the player explicitly pressing "Spin" or pulling the handle. The gaming device 104 in question may not have reels. For instance, cards may be dealt or numbers may be drawn in order to determine an outcome. Furthermore, an outcome may resolve in multiple stages. For instance, a first stage provides entry into a bonus round, and the second stage reveals the number of coins the player has won. In still other variations, the player may make multiple initiations. For example, in many versions of Video Poker, a player first initiates the dealing of a primary hand, and later initiates the dealing of cards to replace any cards discarded by the player from the primary hand. In some gaming devices 104, a player may not only initiate the spinning of the reels, but may also initiate the stopping of the reels and thus, the resolution of the outcome.

The time line described above serves as a convenient reference, since many embodiments of this invention will account for when in the time line certain player actions occur, and whether such player actions are appropriate for when they occur. For example, it may be of significance if the player presses "Spin" during the period when the reels are already spinning. Such action by the player may indicate impatience to initiate a subsequent handle pull, and may thereby indicate a desire for faster play.

As indicated above, the gaming device 104 depicted in FIG. 3 may have any number of different input devices 314 with which a player might interact. In addition to those discussed above, input devices 314 may take the form of physical buttons, "virtual buttons" displayed as touch-sensitive areas on the display screen, handles, knobs, switches, keys, microphones, levers, joysticks, roller balls, mice, triggers, antennae, coins slots, bill validators, credit card slots, player tracking card slots, disk drives, disk readers, receptacles, and so on. Input devices 314 may be electronically (or otherwise) coupled to the processor 300 of the gaming device 104. Each input device 314, when actuated, may provide a signal to processor 300 of the gaming device 104. Such signals may represent an instruction to cash out the player's credit balance, to initiate a handle pull, to increment or decrement a wager amount, to add money to a credit balance, to designate a certain number of pay lines, to indicate a selection of cards or other indicia, etc. In one of its monitoring capacities, the gaming device 104 may monitor the player's interactions with the various input devices 314 and record such actions in the player session database of FIG. 5. The gaming device 104 may record the moment at which the player first interacts with an input device. For example, the gaming device 104 may record the moment at which a player first depresses a plastic button, or first pulls the handle away from its default position, or first puts a coin in a coin slot.

The gaming device 104 may record the moment at which a player finishes his interaction with an input device. For example, the gaming device 104 may record the moment a player releases a depressed button, takes his finger off a touch screen, or releases the handle.

The gaming device 104 may record the strength or pressure with which the player interacts with the input device. For example, the gaming device 104 may record the average or maximum force a player applies to a button, or the average or maximum force with which a player pulls the handle.

The gaming device 104 may record the amount of variation in the force with which the player interacts with an input device. For example, even while maintaining a button in depressed mode, the player may vary the amount of force he applies to the button. This recording may take the form, for example, of a number of force readings taken at slightly different times.

The gaming device 104 may record the speed with which a player interacts with an input device. This measurement is particularly appropriate with respect to the handle of a gaming device 104, which may be pulled at a number of different speeds. However, a gaming device 104 may also record the time between when a player first makes contact with a button, and depresses the button fully. Such a time duration may indicate the speed at which the player's finger approached the button so as to depress it.

The gaming device 104 may record the part of the input device with which the player interacted. For instance, the gaming device 104 may monitor whether the player pressed a button squarely in the middle, or whether the player just nicked the corner of a button.

In the case of microphone input devices, the gaming device 104 may monitor the volume with which the player spoke, clapped, or otherwise interacted with the microphone.

The gaming device 104 may record whether a player has interacted correctly with a particular input device. For instance, the gaming device 104 may record whether the player inserted his tracking card backwards into the player tracking card reader or whether the player inserted his player tracking card into a slot for credit cards.

The gaming device 104 may also monitor a player's interaction with parts of the gaming device 104 not specifically designated for player input. For example, a player might reach for a "virtual button" on a touch-sensitive display screen, but miss and touch an area of the display screen where there is no button. However, the gaming device 104 may still record the touch.

The gaming device 104 may record any moment of time to any desired accuracy, e.g., to tenths of a second, hundredths of a second, etc.

The gaming device 104 may additionally monitor other events, including events that are partly or entirely under the control of the gaming device 104. Such events may include the moment at which reels actually began to spin, the moment at which an outcome resolved, the actual outcome that occurred, the portions of the reels that were visible to the player when the outcome resolved, including such portions of the reels that were not on any selected pay line (and so did not constitute the outcome) the moment at which the gaming device 104 began to credit a player's meter with any winnings for a handle pull, the moment at which the gaming device 104 finished crediting a player's meter with any winnings for a handle pull, the moment at which a player was allowed to initiate a next handle pull (e.g., a player may be allowed to initiate a handle pull only after a certain period of time has elapsed since the resolution of the previous outcome), the moment at which a particular screen of a bonus round was displayed to the player, the moment at which the bonus round resolved, the moment at which a particular outcome within the bonus round resolved, and/or the moment at which the gaming device 104 signaled to the player that it had registered a prior player input (e.g., when a player presses "Bet 1", the gaming device 104 then signals that it has registered the input by decrementing the player's credit balance and incrementing the "Current Wager" balance, or by lighting or darkening the "Bet 1" button pressed by the player). Another example of recording the moment at which the gaming device 104 signaled to the player that it had registered a prior player input may be the gaming device 104 registering a "hold" choice made by a video poker player by highlighting the card that the player has chosen to hold.

The gaming device 104 may not only monitor individual events, but may also keep a tally of the number of a particular event or group of events that has occurred. For example, the gaming device 104 may keep tallies of the number of handle pulls the player has initiated since commencing play at the gaming device 104, the number of coins a player has wagered on a single handle pull, the number of times a player has pressed the "Spin" button since the resolution of the prior outcome, the number of times a player has pressed a button to view the pay table, and/or the number of times a player presses a "Stop" or similar button so as to get the reels to stop spinning, before the reels actually do stop spinning.

The gaming device 104 may also monitor events that do not directly involve the gaming device 104, or that do not involve player interaction with the gaming device 104. For example, the gaming device 104 may have an attached camera which focuses on the player's face and/or eyes. The gaming device 104 may contain software for analyzing a person's facial expressions. Thus, the gaming device 104 may monitor when the player is happy, sad, distracted, focused, or confused, even though a player's facial expressions ordinarily have nothing to do with his interaction with the gaming device 104. A gaze detection system may also be employed to determine how a player is on the reels of a gaming device. The gaming device 104 may employ numerous other sensors. For example, heat sensors may be used for monitoring the proximity of the player to the gaming device 104, the outside temperature, fluctuations in the player's body temperature due to nervousness or other emotions, proximity of friends of the player or other people, and so on.

Smoke detectors may be used for determining whether the player is smoking, or whether a nearby player is smoking. Pressure sensors on the exterior of the gaming device 104 may be used for measuring the weight of any drinks, coins, or other objects placed by the player on the gaming device 104. The pressure sensors may also measure the weight of the player's hands or arms, and thereby allow an estimation of the player's total weight. The gaming device 104 may be electronically coupled to the player's chair, which may itself contain pressure sensors. Pressure sensors in a chair, or in the ground, for that matter, may determine the player's weight, and also the amount of weight that a player is putting on a chair. For example, a player who is not fully sitting may wish for more rapid play, as he may be in a rush to get somewhere and therefore unable to sit down.

Microphones may be used for analyzing utterances by the player, conversations between the player and another, for listening to background music or conversations, and so on. For example, the gaming device 104 may contain voice recognition software. If the player utters, "This is too slow," then the gaming device 104 may interpret the utterance and speed up play, even though the gaming device 104 may not have prompted the utterance.

(b) Determine Whether the Monitored Play Meets Predetermined Criteria

In Step S2, it is determined if the monitored play meets predetermined criteria. The gaming device 104 may derive more complex statistics from any of the events and measurements recorded as described above. For example, if the gaming device 104 has recorded the moment at which a player first presses a "Spin" button, and the moment at which the player pressed the "Spin" button a second time, then the gaming device 104 may determine the time interval between the player's first and second presses of the "Spin" button by subtracting the time of the first press from the time of the second press. To determine the number of times that the player has pressed the "Spin" button, for a given handle pull, while the reels were spinning, the gaming device 104 may reference the time at which the reels began spinning, the time at which the reels finished spinning, and may then tally up the number of "Spin" presses that occurred at moments in time falling between the time the reels began spinning, and the time the reels finished spinning. It will be appreciated that the gaming device 104 may derive numerous other statistics.

Other more complex statistics include sums, averages, standard deviations, medians, modes, etc. of other statistics. For example, one useful statistic may be the average number of times a player hits the "Spin" button while the reels are already spinning, with the average taken over ten handle pulls. Another exemplary statistic is the standard deviation in the amount of time measured between when the reels stop spinning, and when the player presses "Spin" to initiate a new spinning of the reel, with the standard deviation taken over a sample of thirty handle pulls. Still another exemplary statistic is the percentage of handle pulls, out of a sample size of one hundred handle pulls, in which the player inputs a signal to stop the spinning of the reels while they are still spinning.

FIG. 6 depicts an example database 310 containing illustrative summary statistics for a player session. The database 310 tracks the number of various events that occurred over ten minute intervals during a playing session. As discussed above, the database 310 tracks the number of handle pulls made, the number of excess times a player pressed a "Bet 1 per line" button in order to initiate the spinning of the reels, the number of times the player pressed a "Bet 1 per line" button once the reels were already spinning, the number of times the player held any button down for an excessive period of time (here one second or more), and the number of times a player tried to insert coins when the reels were still spinning. The gaming device 104 may use any of these and other statistics in determining whether or not to change various parameters of the gaming device 104.

The rules database 312 depicted in FIG. 7 lists certain criteria that may trigger an adjustment of a parameter of the gaming device 104. In accordance with some embodiments of the present invention, parameters are adjusted so as to directly or indirectly speed or slow the maximum potential rate of play. In one example, a quicker resolution of an outcome from the time the reels begin spinning may directly speed up the rate of play by allowing the player to generate more outcomes per minute. In another example, increasing the sensitivity of various input devices may allow the player to more quickly provide inputs to the gaming device 104, thereby indirectly speeding up the rate of play. Many different criteria may be used to form the basis for making an adjustment of a gaming device parameter.

A criterion that may be used might include a player pressing the "Spin" button more than a predetermined percentage of the time, prior to the initiation of the spinning of the reels. For example, on 30% or more of 100 measured handle pulls (or spins), the player has pressed "Spin" at least twice prior to the initiation of the spinning of the reels. Such action may indicate that the player is impatient to have outcomes resolved more quickly. It may also indicate that the player is often pressing the "Spin" button too lightly, so that the spin signal is not registering with the gaming device 104. The player has therefore compensated by pressing the "Spin" button multiple times on each spin. Therefore, in response, the gaming device 104 may increase the sensitivity of the "Spin" button.

Another criterion that may be used might include a player pressing any button on a gaming device 104, or interacting with any input device, more than is necessary to accomplish a desired task. The specific criterion may look at the number of times a player has pressed a button unnecessarily on a single handle pull, the percentage of handle pulls during which the player has pressed a button unnecessarily, the percentage of handle pulls during which the player has made more than a predetermined number of unnecessary button presses, and so on. For instance, the player presses a "Bet 3" button multiple times where it accomplishes nothing (in resolving the reels) to press the button more than once (e.g., 3 is the maximum bet). The player might hit a "Deal" button on a video poker machine multiple times, or may hit the same "hold" button multiple times, where holding a card is only a binary decision requiring a single input. Any repetitious and unnecessary interaction by a player with an input device may indicate impatience on the part of the player to more quickly resolve outcomes, or may indicate that an input device of the gaming device 104 lacks the sensitivity to register the player's input. Once again, in response, the gaming device 104 may have the reels resolve more quickly, or may increase the sensitivity of input devices.

Another criteria that may be used might include a player pressing any button on a gaming device 104, or interacting with any input device, at a time when such interaction is improper or does not make sense. For example a player might press a "Bet 1" button when the reels are already spinning, or when he has a zero credit balance. The player might press a "Bet 3 lines" button while the reels are already spinning. A player might press the "Spin" button before he has selected a wager amount. A player might press "Spin" during a bonus round. A player might try to insert coins into the machine at an unconventional time (e.g., when the reels are spinning). A player might try to designate a number of pay lines to be played after already having designated a bet size, and on a gaming device 104 where a number of pay lines must be designated before a bet size. One specific criterion might be that the player presses the "Bet 1" button when the reels are spinning on five consecutive pulls. Another criterion might be that a player presses any button improperly on seven out of ten consecutive pulls.

Another criterion that may be used might include a player accessing a descriptive or instructional screen more than a predetermined number of times since he commenced play, or more than predetermined number of times during the last one hundred handle pulls, etc. A descriptive or instructional screen might be, for example, a screen which displays text or graphics illustrating the theme of the gaming device 104, the manner in which the gaming device 104 is to be operated by the player, the way the bonus rounds work, the prizes a player can win, etc. When a player accesses a descriptive or instructional screen, it may indicate that the player is unsure of how to play the gaming device 104, or unsure of what to expect when he does play the gaming device 104. In response to a player's accessing a descriptive or instructional screen, the gaming device 104 may increase the accessibility of one or more screens. For instance, the gaming device 104 may increase the size of the virtual buttons necessary to access the screens. The gaming device 104 may also move the screens frequently accessed by the player up in the screen hierarchy, if the player first needed to access intermediary screens before reaching his desired screens. Another alternative is for the gaming device 104 to display descriptive or instructional text directly on the main screen, i.e., the screen showing the reels or the screen typically in view. The gaming device 104 may also output descriptive or instructional context via other means, such as via an audio speaker.

Another criterion that may be used might include a player accessing a screen illustrating one or more lines of the pay table more than a predetermined number of times since he commenced play, more than ten times in the last hour, five out of the last six times he achieved the outcome "bar-bar-double bar", etc. Once again, the gaming device 104 may make frequently accessed pay table screens more accessible, or may display or output information from such screens directly to the player via the main screen or via microphone.

Another criterion that may be used might include a player pressing a button on the gaming device 104, where the button reads, "Play faster," "Spin faster," or is similarly labeled.

Another criterion that may be used might include, for example, a player's average wager size over the last ten pulls is larger than the player's average wager size over the prior ten pulls. Related criterion include: whether the player's wager size in the last pull is larger than the player's wager size ten pulls ago, whether the player's average wager size has increased by more than 100% when the last ten pulls are compared with the prior ten pulls, whether the size of the wager has fluctuated more than a predetermined amount (e.g. more than two standard deviations), whether the player has wagered more than five coins in more than thirteen of the last twenty handle pulls, and less than four coins in thirteen of the prior twenty handle pulls, etc. In general, any measure of an increasing wager size by the player may serve as a criterion for the gaming device 104 to adjust one or more parameters. For example, the gaming device 104 may see an increased wager size as a desire for more "action," and may therefore adjust parameters so as to increase the maximum potential rate of play. In another example, the gaming device 104 notes that it is making a larger profit when the player's wager size increases, and so may actually slow the maximum potential rate of play to a level that may be more comfortable to the player.

Another criterion that may be used might include, for example, a player's average wager size over the last ten pulls is smaller than the player's average wager size over the prior ten pulls. Many other statistics indicating a decline in wager size may be used as criterion. A declining wager size may indicate that the player wishes to slow the rate of play. Alternatively, the gaming device 104 may see declining wager size as a declining rate of accumulation of profits, and may increase the maximum potential rate of play so as to compensate. A player's declining wager size may also be seen as an indication that the player is ready to leave, especially if the player also has a low balance.

Another criterion that may be used might include, for example, a player's average wager size over the last fifty pulls has exceeded two and a half coins. Other related statistics include, whether the player has bet the maximum possible bet in eight out of the last ten pulls, whether the player has bet at least five coins in the last seven consecutive pulls, and so on. Many other statistics can be used to summarize a player's bet size over time. If a player typically has a large bet size, then the player may have a desire for more "action", and the gaming device 104 may accordingly adjust a parameter so as to speed up the maximum potential rate of play. If the player typically (e.g., on 80% of the last fifty handle pulls) has exactly the same bet size, then the gaming device 104 may create and display a new button with a player's preferred bet amount on it. In this way, the player may save time in choosing his bets, and may therefore play faster.

Another criterion that may be used might include, for example, a player's credit balance exceeding one hundred coins over the last fifty spins. Related statistics include whether the player has had an average balance of more than one hundred coins over the last ninety spins, whether the player has had a balance of more than seventy-five coins for twelve out of the last forty spins, or whether the player has had a balance in the range of twenty to forty coins over the past fifty pulls. There are many other possible statistics that may be used to summarize a player's credit balance over time. A player with a high credit balance may desire a large number of outcomes, as a large credit balance may indicate a readiness to withstand long streaks of losing outcomes. Such a player may desire to see outcomes quickly, as he expects to see a lot of them and may not wish to spend an exceedingly long period of time at the gaming device 104. Therefore the gaming device 104 may adjust a parameter to increase the maximum potential rate of play for a player with a high credit balance, as indicated by one or more criterion.

Another criterion that may be used might include, for example, a player inserting more than a predetermined amount of money within the last twenty handle pulls. Related statistics include whether the player has inserted a $50 bill in the last ten minutes, whether the player has inserted a $100 bill since the prior handle pull, whether the player has inserted one or more coins since the last handle pull, and the like. There are many other statistics that summarize how much money the player has inserted into the gaming device 104 over time. A player who has inserted money, especially a relatively large amount of money (e.g., $50 or $100), may wish to play more rapidly, as the newly inserted money may indicate pleasure with the gaming device 104, or may indicate a desire to see many outcomes. The gaming device 104 may therefore adjust a parameter to increase the maximum potential rate of play.

Another criterion that may be used might include a player making wagers with an increasingly larger loss probability. For example, a video poker player who tries to complete straits or flushes instead of merely accepting smaller payouts for pairs may desire a different rate of play.

Another criterion that may be used might include, for example, a player's average number of lines played over the last twenty pulls is two more than the player's average number of lines played over the prior twenty pulls. Other related statistics include whether the player's average number of lines played over the last five pulls is larger than the average number of lines played during the player's first five pulls of the session, whether the number of lines played has increased in each of the last five handle pulls, and so on. When a player plays more lines, he may indicate a desire for more "action", and the gaming device 104 may respond by adjusting a parameter to increase the maximum potential rate of play.

Another criterion that may be used might include, for example, a player having achieved a winning outcome in seven of the last ten handle pulls or five winning outcomes in a row. Related statistics include whether the player has won more than twenty coins during the last handle pull, whether the player has won a total of twenty or more coins over the last three handle pulls, whether the player has just achieved a winning outcome consisting of three like symbols, whether the player has just played in a bonus round, and so on. Many other statistics may be used to summarize the player's attainment of winning outcomes over time. When a player has achieved a relatively high proportion of winning outcomes over time, especially recently, the player may desire a more rapid rate of play so as to more quickly achieve anticipated future winning outcomes. Similarly, various statistics may measure the number of non-winning, or losing outcomes the player has attained over time. A player who has attained a relatively high proportion of losing outcomes over time, especially recently, may desire to play more rapidly so as to quickly get over the pain of the losing outcomes, and to achieve some more winning outcomes.

Another criterion that may be used might include the time of day. Exemplary criterion include whether it is within one hour of noon (i.e. lunch time, when many people break from gambling to have food), whether it is within ten minutes of an upcoming show, whether it is past 11:00 PM (a common bedtime), whether it is within ten minutes of an upcoming sports game (e.g., the Yankees game, or the Super bowl), whether it is ten minutes before a scheduled dinner reservation, etc. When a player is scheduled to take part in an upcoming event, or may have to leave for some other reason, then the player may desire to play more rapidly so as to experience more outcomes in the limited time before his imminent departure. Similarly, the gaming device 104 may wish to increase the maximum potential rate of play so as to make more profits from the player before he leaves.

Another criterion that may be used might include, for example, the player having waited more than an average of three seconds over each of the last one hundred handle pulls, since the resolution of an outcome of the first handle pull, until selecting his bet size for the next handle pull. Related statistics include whether the player has waited more than five seconds in at least eighty of the last one hundred handle pulls between the resolution of an outcome for the first handle pull until the resolution of the outcome for the next handle pull, or whether the player has waited more than ten seconds before initiating a subsequent handle pull in at least nine out of the last ten handle pulls in which three like symbols lined up from left to right but in which the player did not receive a payout. A player who pauses more than a predetermined amount of time after the resolution of an outcome in which he did not receive a payout may be presumed to be confused as to why he did not receive the payout. As a result, the gaming device 104 may provide the player with an explanation as to why he did not receive the payout. For example, a gaming device may display a message such as: "Houses are not winning symbols, so you do not win anything even if you line up three houses."

Another criterion that may be used might include, for example, the average maximum pressure the player has applied to the "Spin" button over the last ten pulls having exceeded one pound per square inch. Many other statistics may be used to summarize the pressure or force that a player typically applies to a button or other input device of the gaming device 104. Relatively higher amounts of pressure or force may indicate a desire for more rapid play, whereas relatively lower amounts of pressure or force may indicate a desire for slower play, or a comfort with the current rate of play.

Another criterion that may be used might include the player responding to a question asked by the gaming device 104. The response may be in the affirmative or negative, may be one of several response choices, or may be free form. For example, the gaming device 104 may print the following text on its display screen, "Are the reels spinning too slowly?" The gaming device 104 may further display two possible answer buttons, one labeled "Yes" and one labeled "No". The player may then respond to the question by pressing one of the two buttons. Another question for the player might read, "Should the reels spin A) Faster, B) Slower, C) As They Are." The player may then respond by touching buttons labeled "A", "B", or "C".

There are, of course, many other ways in which the gaming device 104 might ask a question of the player, and there are many other ways in which the player might respond. For example, the gaming device 104 might present a question to a player in audio form using prerecorded or synthesized voice presented via a speaker. The player might also respond orally, using a microphone, for example. In other embodiments, the gaming device 104 does not ask a question explicitly, but gives the player the persistent possibility of instructing the gaming device 104 to adjust one or more parameters of play. For example, the gaming device 104 might display two buttons on the display screen at all times. A heading over the buttons says "Reel Speed", one button is labeled "Faster" and the other is labeled "Slower". The player may then, at any time, press one of the buttons to adjust the reel speed. FIG. 4 illustrates a gaming device 104 having two buttons, labeled "Faster" and "Slower," for increasing or decreasing the speed of the reels.

Other exemplary questions that may be asked of a player include: "Are the reels spinning too fast?"; "Do the bonus rounds last too long?"; "Are the bonus rounds too short?"; "Does it take too long for your winnings to be credited to your credit balance?"; "Is the spin button always registering when you press it?"; "Do you wish to play faster?"

Another criterion that may be used might include, for example, the player making ten pulls since starting play. Related statistics include whether the player has played at least an hour, whether the player has made a number of pulls divisible by ten, whether the player has made twenty-five pulls since last depositing money into the gaming device 104, and so on. Significantly, a gaming device 104 may adjust a parameter effecting the speed of play, or any other aspect of play, solely on the basis of time played, number of pulls made, etc. That is, a player need not demonstrate any impatience, discomfort, or incomprehensiveness with his current play, and yet, the gaming device 104 may still increase the maximum potential rate of play by, for example, decreasing the time it takes for an outcome to resolve once the player has pressed the "Spin" button. One reason for the gaming device 104 to increase the maximum potential rate of play is that, in general, the profits made by the gaming device 104 over any given period of time are directly proportional to a player's actual rate of play during that time period. It should be noted, however, that the gaming device 104 is not solely in charge of dictating the rate of play. A player typically has a choice of when to insert coins, when to press a "Bet 1" button, when to press a "Spin" button, and so on. Thus, no matter how quickly a gaming device 104 causes reels to resolve, the player cannot be made to play at a rate he does not want to. Put another way, the gaming device 104 may allow and encourage a faster rate of play by taking as little time as possible to perform its functions. However, the gaming device 104 cannot, in general, force a faster rate of play, unless the player engages an automatic spin program or plays on a machine where such a program is a default program. To engage an automatic spin program, a player may first prepay for a large number of handle pulls. Once the player has prepaid, the gaming device 104 has the ability to generate the outcomes of the handle pulls as quickly or slowly as it is programmed, subject to any terms of the prepayment for the handle pulls. Another exception is the operation of a bonus round. In theory, the gaming device 104 might cause the bonus round to resolve very rapidly. If the player is allowed choices in the bonus round, then the gaming device 104 may impute a default choice to the player if the player does not choose within a given period of time. In any event, the gaming device 104 may adjust various parameters of play for no apparent reason. Thus, the gaming device 104 may increase the rate at which reels resolve at regular intervals, say every five minutes, or every 20 handle pulls. The gaming device 104 may then look to other criterion to see whether it should refrain from adjusting one or more parameters. For example, if the average duration of time between when an outcome resolves, and when a player designates his bet size for the next handle pull, has increased over the last 10 handle pulls, then the gaming device 104 may infer that the player cannot comfortably assimilate the outcomes any faster. Thus, the gaming device 104 may refrain from increasing the speed at which reels resolve.

Other criterion that may be used include any practicable combination of any of the above criterion. For example, if a player has pressed the "Spin" button an average of one extra time per pull over the last twenty pulls, and it is ten minutes until an upcoming show, then it may be a strong signal to the gaming device 104 to adjust parameters so as to increase the maximum potential rate of play.

(c) Adjust a Parameter of the Gaming Device Based on the Monitored Play and the Predetermined Criterion In Step S3, a gaming device parameter may be adjusted based upon the outcome of the determination made in Step S2. If the gaming device 102 (or the casino server 102) determines that a parameter of the gaming device 104 should be adjusted, there are many parameters that may be adjusted. A parameter that may be adjusted is the time it takes for an outcome to resolve once the player has initiated a handle pull. Another parameter that may be adjusted is the time it takes for the reels to begin spinning once the player has initiated a handle pull. Another parameter that may be adjusted is the time it takes for a particular screen to be shown to the player once the player has chosen the screen. For example, if a player has pressed a button labeled "pay table", then there is some adjustable time period before which the screen of the gaming device 104 changes and the actual pay table is shown.

Another parameter that may be adjusted is the organization and accessibility of any screens providing descriptions of the game, help, instruction, views of pay tables, and so on. For instance, if a particular line of a pay table is only viewable on a display screen following three presses of a button, the gaming device 104 may reorganize the screens for display so that access to the line may be obtained through only a single press of a button. That is, a screen that was three links deep in an organizational hierarchy may be moved to be only one link deep in the hierarchy.

Another parameter that may be adjusted is the sensitivity of the touch screen. With a more sensitive touch screen, a player need not spend as long pressing a particular area of the screen in order to get a desired result. With a less sensitive touch screen, a player may be less likely to make mistakes.

Another parameter that may be adjusted is the sensitivity of the buttons, handle, and other input devices.

Another parameter that may be adjusted is the time it takes for the bonus round to resolve once the player has entered the bonus round.

Another parameter that may be adjusted is the time it takes for the gaming device 104 to pay a player for a winning outcome, including either the time it takes to credit wins to the player's meter, or the time it takes to drop coins into the coin tray.

Another parameter that may be adjusted is the time to signal to a player that a player's input has been received. For example, when a player chooses to hold a card in video poker, the "hold" button corresponding to that card may light up so as to indicate that the gaming device 104 has registered the player's input. Other signals the gaming device 104 may provide include: lighting or darkening buttons; changing the displayed position, size, highlighting, or orientation of symbol indicia (e.g., showing a chosen card as slightly depressed from the plane of the other cards); or changing the displayed position, size, highlighting, or orientation of "virtual" buttons on the touch screen (e.g., showing a chosen button as being depressed).

Another parameter that may be adjusted is the length of the time window during which a player may not insert new coins into a gaming device 104. A time window during which a player may not insert new coins occurs, for example, while the reels of a gaming device 104 are spinning. The gaming device 104 may shorten this time window, without necessarily shortening the time during which the reels are spinning, by allowing the player to insert new coins even while the reels are still spinning.

Another parameter that may be adjusted is the amount of instruction provided to a player. For example, if a player is pressing the wrong buttons to accomplish a desired action, or otherwise interacting with the gaming device 104 in an incorrect manner, then the gaming device 104 may communicate instructions to the player as to how to more correctly interact with the gaming device 104. Presumably, if the player follows the instructions, then the player will be able to play more quickly. For example, suppose the player repeatedly presses the "Spin" button before indicating a wager amount. The gaming device 104 may automatically display text to the player advising the player that he must first designate a wager amount before he can spin the reels.

Another parameter that may be adjusted is the amount of explanation provided to the player. For example, if a player is pressing buttons in an incorrect fashion, the gaming device 104 may provide audio or text messages to the player as to the correct way to interact with the gaming device 104.

When adjusting various parameters, the gaming device 104 may be configured to only make limited adjustments at any one time, or over the course of any given time period. For example, the gaming device 104 may only decrease the time from when a player presses "Spin" to when the reels resolve by a maximum of five hundredths of a second per pull. In another example, the gaming device 104 may decrease the time from when a player presses "Spin" to when the reels resolve by a maximum of five hundredths of a second an any one handle pull, but not more than a total of 20 hundredths of a second over any period of ten consecutive handle pulls. By making such small adjustments, the adjustments may not be immediately obvious to the player, and may therefore not interrupt the player's rhythm of play. In some embodiments, a parameter of play may be adjusted by a magnitude that depends on the triggering condition. So the gaming device 104 may adjust a parameter by up to a first maximum amount if one triggering condition is present, but may only adjust the parameter by up to a smaller maximum amount if a second triggering condition is present. In some embodiments, if multiple triggering conditions are present, the gaming device 104 may adjust a parameter by up to a third of a maximum amount. As an example, a gaming device 104 may decrease the time from when a player presses "Spin" to when the reels resolve by two hundredths of a second per pull when no particular triggering condition is present. However, if the player has pressed the "Spin" button more than three times per handle pull for at least nine out of the last fifteen handle pulls, then the gaming device 104 may decrease the time from when a player presses "Spin" to when the reels resolve by ten hundredths of a second per handle pull. Of course, there are many other ways by which to make adjustments to parameters.

The gaming device 104 may also have predetermined limits beyond which it will not adjust certain parameters. For instance, the gaming device 104 may never decrease the time from when a player presses "Spin" to when the reels resolve to a time less than eighty hundredths of a second, nor may the gaming device 104 ever increase such time to more than five seconds.

The rules database 312 of FIG. 7 lists example parameters and corresponding adjustments with example limits that may be made to the parameters. As mentioned above, FIG. 7 lists only exemplary criterion, and it is understood that there are numerous other possible criterion for adjusting parameters, numerous other parameters that may be adjusted, and numerous other degrees to which parameters may be adjusted.

2. Manual Embodiments

In some embodiments of the methods of the present invention, the system 100 does not attempt to deduce optimal settings to meet player preferences based upon various criterion. Instead, a player is simply asked to adjust specific parameters (or combinations of parameters) himself. It is left to the player to determine exactly which, how much, and when parameters are to be adjusted. The system 100 may continuously ask a player if there is any parameter he would like to adjust, be always ready to receive the answer, and make an adjustment based upon the received answer. As with the automatic embodiments, the system 100 may continuously loop through these three steps.

In Step S4, a player at a gaming device 104 is asked about a preferred mode of operation of the gaming device 104. The question may be in any of the forms described above and/or may simply consist of a configuration options menu that is always accessible on the gaming device 104. The mode of operation may be related to a single parameter or a combination of several parameters. Thus, players may be asked if they would like the pace of the gambling to be increased while the gaming machine may be contemplating decreasing the reel resolution time and the time spent making or crediting payouts.

In Step S5, the player's response is received. This step may be implemented in any of the numerous ways described above related to player inputs. The response is received by the gaming device's (or the casino server's) processor as a signal. In response, in Step S6, the appropriate parameter of the gaming device 104 is adjusted. Based upon the player's response, one or many parameters may be adjusted at once.

F. Example Illustrative Embodiments of the Invention

The following very specific examples are provided to illustrate particular embodiments of the present invention, particularly from the perspective of potential users of the system 100, including players and casinos.

(a) Example 1

Sam sat down at a nickel slot machine, and inserted a $20 bill. He pressed "Play 9 Lines" to enable nine pay lines. He then pressed "Bet 1 Coin Per Line", and the reels began spinning. Three seconds later, the reels stopped spinning. Again Sam pressed "Bet 1 Coin Per Line" and the reels started spinning. Once again, three seconds later, the reels stopped spinning. After a few more repetitions, Sam began to get impatient and frustrated. He wanted to see his outcomes more quickly. Unconsciously Sam began to press the "Bet 1 Coin Per Line" button harder and harder. Sam would also press the button again before the reels had stopped spinning, hoping to get the reels to stop so that he could see his outcome and get onto the next one. Sam kept pressing the "Bet 1 Coin Per Line" repeatedly and harder during each handle pull. Sure enough, he began to notice that the reels were stopping more quickly. Sam kept trying to hurry the reels, and they gradually kept resolving faster and faster. Eventually, the reels spun for only half a second on every handle pull. This was fast enough for Sam, and so he stopped hammering the "Bet 1 Coin Per Line" button and settled down for a long session.

(b) Example 2

Linda had been playing at her slot machine for ten minutes when a text question came up on her screen. It said, "Linda, our records indicate that this is the first time you have played this particular type of machine, would you like the reels to spin more slowly?" Two buttons then appeared as display areas of her touch screen. One said "Yes" and one said "No". Linda touched the "Yes" button. On subsequent handle pulls, Linda noticed that the reels took a little more time to resolve from the time they began spinning, and this afforded her to enjoy a more leisurely place to learn the game.

(c) Example 3

Mary sat down at a slot machine. When she began play, the reels took three seconds to resolve from the time they began spinning. Mary was doing fairly well, and she was still at the slot machine an hour later. Now, however, the reels took only one second to resolve from the time they began spinning. Yet, the time of resolution per handle pull had decreased so slowly that Mary had not even noticed.

G. Additional Embodiments of the Invention

The methods of the present invention have been discussed at length with respect to embodiments involving only gaming devices 104. However, the present invention may involve casino servers 102 as well as gaming devices 104. As previously indicated, the casino server 102 may store any of the databases 308, 310, 312 described above.

In some embodiments, the casino server 102 may perform such functions as calculating summary statistics and alerting gaming devices 104 as to upcoming events (e.g., shows) that might influence a player's desired rate of play. Additionally, the casino server 102 may monitor multiple gaming devices 104 to determine whether criterion used by the gaming devices 104 for adjusting gaming device parameters has in fact resulted in greater profitability or greater player entertainment and/or satisfaction. The casino server 102 may adjust such criterion based on its determinations, and may periodically provide new criterion to gaming devices 104.

In some embodiments, the casino server 102 may also store gaming device configurations that have been found to suit a particular player. For example, whereas it may have taken a first gaming device an hour to adjust its reel speed/resolution time to the optimal speed for a particular player, a second gaming device can build on the learning of the first gaming device, identify a player (via casino server 102 provided information) as having previously been at the first gaming device, and immediately configure itself according to the player's preferences and/or optimal configuration. This learning process can be mediated by the casino server 102.

In some embodiments, the casino server 102 may host a Web site that serves as an online casino. The Web site may allow a remote player, using a terminal (player device) that is connected to the Internet, to play electronic simulations of such physical slot machines as are found in a physical casino. Many of the embodiments described above apply also to gaming devices 104 or their representations that are played at an online casino.

In some online embodiments, a casino server 102 may track player actions such as, for example, the time at which a player mouse clicks on a "Spin" button, "Bet 1" button, or any other button; the time at which a player enters a credit card number; the time at which a player enters a password, or other identifier; the time at which a player brings his mouse pointer over a button, but does not click on it; the time at which a player views a menu associated with a gaming device 104 (such menus may include help menus, instructional menus, or menus with different options for play); and the time at which a player presses any one or more keys on his keyboard for providing input to the casino server 102 (i.e., pressing "Alt-s" may allow the player to spin). As indicated above, by tracking these types of data, a casino server 102 and/or a player device executing a gaming device simulation program may make determinations as to the optimal reel resolution time for the player.

In some embodiments, the casino server 102 and/or a player device executing a gaming device simulation program may also derive more complex statistics, such as the number of times a player mouse-clicks on a spin button at a time when the reels are already spinning. The casino server 102 and/or a player device executing a gaming device simulation program may then adjust a parameter of play based on the player actions it has monitored, and based on statistics it has derived from those actions.

In some online embodiments of the present invention, the casino server 102 and/or a player device executing a gaming device simulation program may recognize that any delays in a player's play could be due to a number of factors that would not be present in a casino. For example, a remote player could have the stove on, could have the television on, could receive a phone call, etc. There could simply be latency in the transmission of signals from the player device to the casino server 102. These and other factors might often lead to long pauses in play. The casino server 102 and/or a player device executing a gaming device simulation program may therefore choose to not necessarily interpret long pauses as an indication that, e.g., the player is confused with the play of the slot machine simulation, or that the player wishes spins to resolve less rapidly. Therefore, in some embodiments, a casino server 102 may interpret pauses in play that are within a predetermined range to signify confusion, but pauses that are longer than a predetermined threshold to signify that the player has become distracted with something else. Then, only for the former length pauses would the casino server 102 and/or a player device executing a gaming device simulation program adjust a parameter of the gaming device.

In some online embodiments of the present invention, if a player appears to be dissatisfied with a slow rate of play, a casino server 102 and/or a player device executing a gaming device simulation program may, in addition to speeding the resolution of reels, call up a second slot machine simulation. The second slot machine simulation could be, for example, in a different window on the player's computer screen. The player would then have the opportunity to play two machines simultaneously, and thereby enjoy an effectively greater rate of play. The casino server 102 and/or a player device executing a gaming device simulation program might also suggest to the player, e.g., via a text message, that the player try a different game entirely, perhaps one with a faster pace. The casino server 102 would, advantageously, be able to display the new game to the player instantly, whereas in a physical casino, a player might have to switch seats in order to play a new game.

In some embodiments, a gaming device 104 may ask the player various questions about his comfort level, and adjust parameters of the gaming device based on the player's responses. It is likely that a player who is comfortable playing at a gaming device will play at a different rate than a player who is uncomfortable. Thus, by adjusting a parameter of the gaming device that relates to player comfort, the gaming device can indirectly effect the rate of play at the gaming device. For example, the gaming device 104 might ask the player whether or not the sound effects of the gaming device are too loud or too soft, whether or not the text size is too large or too small, whether or not the font or the graphics are pleasing, and so on. The gaming device 104 may then adjust its parameters based on the player's response.

In some embodiments, a gaming device 104 may not only incorporate data about a given player into decisions about whether to adjust parameters, but may also incorporate data about previously monitored players. For instance, suppose 90% of previously monitored players who pressed "Spin" more than twice per handle pull continued play when the time for the reels to resolve was halved. If the current player is also pressing "Spin" more than twice per handle pull, then the gaming device may adjust the speed of resolution by a larger amount than it would have had it not monitored prior players. In other words, the gaming device may learn from prior players to see what parameter adjustments worked for a given pattern of play, and may apply such learning to future players.

In some embodiments, a player device, such as a wireless PDA, may be used to invite a player to alter the reel resolution time of a gaming device 104 and it may alert the gaming device 104 to the player's proximity using, for example, a wireless protocol (such as Bluetooth as described at www-.bluetooth.com/dev/specifications.asp). Once identified, a user's information may be automatically transferred to the gaming device and log him into the casino's network 100. By merely approaching an enabled gaming device 104, the player's device could trigger the gaming device 104 to configure itself to support the player's preferred rate of play. In some embodiments, a cell phone/PDA may be used to track and record the player's preferences.

In some embodiments, a gaming device 104 may be configured to spend a relatively longer period of time displaying a winning outcome than it does displaying a losing outcome. For example, the gaming device may prevent a player from initiating a new handle pull after a winning outcome for a longer period of time than it does after a losing outcome. Therefore, even if the player has lost on most of the handle pulls, he may have spent just as much time looking at winning outcomes as looking at losing outcomes. As a result, the player may enjoy his time gambling more and not perceive that he spent too much time losing.

H. Conclusion

It is clear from the foregoing discussion that the disclosed systems and methods to facilitate rate of play optimization represents an improvement in the art of gaming. While the method and apparatus of the present invention has been described in terms of its presently preferred and alternate embodiments, those skilled in the art will recognize that the present invention may be practiced with modification and alteration within the spirit and scope of the appended claims. The specifications and drawings are, accordingly, to be regarded in an illustrative rather than a restrictive sense.

Further, even though only certain embodiments have been described in detail, those having ordinary skill in the art will certainly appreciate and understand that many modifications, changes, and enhancements are possible without departing from the teachings thereof. All such modifications are intended to be encompassed within the following claims.

What is claimed is:

1. A method comprising:

causing at least one processor to execute a plurality of instructions to monitor play at a gaming device, wherein monitoring play includes:

causing the at least one processor to execute the plurality of instructions to measure a number of times a button of the gaming device has been pressed after a first spin has been initiated and before a second spin has been initiated, the first and second spins being consecutive; and causing the at least one processor to execute the plurality of instructions to adjust a game play parameter based at least in part on the number of button presses measured, wherein the adjusted game play parameter is related to a maximum potential rate of play.

2. The method of claim 1, wherein causing the at least one processor to execute the plurality of instructions to adjust a game play parameter includes causing the at least one processor to execute the plurality of instructions to decreasing a reel resolution time of at least one reel of the gaming device.

3. The method of claim 1, wherein causing the at least one processor to execute the plurality of instructions to adjust a game play parameter includes causing the at least one processor to execute the plurality of instructions to decreasing an amount of time used to provide a payout to a player of the gaming device.

4. The method of claim 1, wherein causing the at least one processor to execute the plurality of instructions to adjust a game play parameter includes causing the at least one processor to execute the plurality of instructions to cause provide additional opportunities to insert a coin into the gaming device to be provided to a player of the gaming device.

5. A gaming device comprising:

a button on a gaming device configured to facilitate a wagering game, the button being configured to generate a signal each time the button is pressed; and a processor coupled to the button and configured to count a number of times the signal is generated during an initiated round of game play of the wagering game and to adjust a game play parameter based on the number, wherein the game play parameter is related to a maximum potential rate of play.

6. The gaming device of claim 5, wherein the processor is further configured to decrease a reel resolution time of at least one reel of the gaming device in response to the number.

7. The gaming device of claim 5, wherein the processor is further configured to decrease an amount of time used to provide a payout to a player of the gaming device in response to the number.

8. The gaming device of claim 5, wherein the processor is further configured to provide a player of the gaming device with additional opportunities to insert a coin into the gaming device in response to the number.

9. A method comprising:

causing at least one processor to execute a plurality of instructions to monitor play at a gaming device, wherein monitoring play includes:

causing the at least one processor to execute the plurality of instructions to determine a first press of a button, the first press initiating a spin of the gaming device;

causing the at least one processor to execute the plurality of instructions to measure a number of second presses of the button subsequent to the first press, wherein the second presses do not initiate a spin; and causing the at least one processor to execute the plurality of instructions to adjust a game play parameter based on the number of second presses measures, wherein the adjusted game play parameter is related to a maximum potential rate of play.

* * * * *